US010526126B2

(12) United States Patent
Zhang

(10) Patent No.: US 10,526,126 B2
(45) Date of Patent: Jan. 7, 2020

(54) RECTANGULAR AIR PACKAGING DEVICE AND MANUFACTURING METHOD THEREFOR

(71) Applicant: Shanghai Air-Paq Composite Material Co., Ltd., Shanghai (CN)

(72) Inventor: Jiaying Zhang, Shanghai (CN)

(73) Assignee: Shanghai Air-Paq Composite Material Co., Ltd., Shanghai (CN)

( * ) Notice: Subject to any disclaimer, the term of this patent is extended or adjusted under 35 U.S.C. 154(b) by 106 days.

(21) Appl. No.: 15/320,306

(22) PCT Filed: May 26, 2015

(86) PCT No.: PCT/CN2015/079782

§ 371 (c)(1),
(2) Date: Dec. 19, 2016

(87) PCT Pub. No.: WO2015/192708

PCT Pub. Date: Dec. 23, 2015

(65) Prior Publication Data

US 2017/0247164 A1 Aug. 31, 2017

(30) Foreign Application Priority Data

Jun. 19, 2014 (CN) ..... 2014 1 0273965
Jun. 19, 2014 (CN) ..... 2014 1 0273978
Jun. 19, 2014 (CN) ..... 2014 2 032917 U

(51) Int. Cl.

| | |
|---|---|
| ***B65D 81/02*** | (2006.01) |
| ***B65D 85/00*** | (2006.01) |
| ***B65D 81/05*** | (2006.01) |
| ***B65D 81/03*** | (2006.01) |

(52) U.S. Cl.
CPC ..... *B65D 81/052* (2013.01); *B65D 81/03* (2013.01)

(58) Field of Classification Search
CPC ..... B65D 81/052; B65D 81/03; A45C 7/0081
USPC ..... 206/522; 383/3, 110, 116; 229/117.32, 229/117.27
See application file for complete search history.

(56) References Cited

U.S. PATENT DOCUMENTS

| | | | | |
|---|---|---|---|---|
| 8,162,180 | B2 * | 4/2012 | Lips | B65D 77/067 220/495.06 |
| 2003/0128898 | A1 * | 7/2003 | Malone | B65D 81/052 383/3 |
| 2005/0263425 | A1 * | 12/2005 | Tanaka | B65D 81/052 206/522 |
| 2005/0284791 | A1 * | 12/2005 | Sadow | A45C 13/021 206/522 |

(Continued)

*Primary Examiner* — Rafael A Ortiz
(74) *Attorney, Agent, or Firm* — Raymond Y. Chan; David and Raymond Patent Firm

(57) ABSTRACT

A rectangular air packaging device and a manufacturing method therefor are provided. The device includes at least one inflatable main body and at least one inflation valve. The inflatable main body includes a plurality of inflation units. Each inflation unit has an inflation chamber. The inflation valve communicates with the inflation chamber, so as to inflate the inflation unit. After being bended and heat-sealed, the inflation units form a plurality of side walls. Two adjacent side walls of the side walls are arranged roughly with a right angle, so that the side walls form a rectangular containing cavity, so as to contain item to be packaged and to provide air cushioning effect to the item to be packaged.

16 Claims, 36 Drawing Sheets

(56) References Cited

U.S. PATENT DOCUMENTS

| | | | | |
|---|---|---|---|---|
| 2006/0207849 | A1* | 9/2006 | Sadow | A45C 7/0081<br>190/18 A |
| 2007/0051655 | A1* | 3/2007 | Yoshifusa | B65D 81/052<br>206/522 |
| 2009/0050509 | A1* | 2/2009 | Liao | B65D 81/052<br>206/522 |
| 2013/0313152 | A1* | 11/2013 | Liao | B65D 81/052<br>206/522 |

* cited by examiner

B-B

RECTANGULAR AIR PACKAGING DEVICE AND MANUFACTURING METHOD THEREFOR

CROSS REFERENCE OF RELATED APPLICATION

This is a U.S. National Stage under 35 U.S.C. 371 of the International Application Number PCT/CN2015/079782, filed on May 26, 2015, which claims priority under 35 U.S.C. 119(a-d) to a Chinese application number CN201410273978.5, filed on Jun. 19, 2014, a Chinese application number CN201420329171.4, filed on Jun. 19, 2014, and a Chinese application number CN201410273965.8, filed on Jun. 19, 2014.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a kind of air-packaging products, and more particularly to a kind of rectangular air packaging device, where inside walls of the air packaging device form a roughly rectangle shape, so as to be suitable to surround around an item to be packaged, so as to provide an air-cushioning effect to the item to be packaged.

Description of Related Arts

Packaging is a general term that describes a process in which a container, a material and an auxiliary are applied to protect an item be means of a predetermined technique method, for facility of storage and transportation, or for sales promotion. In modern society, being stimulated by e-commerce, modern logistic transport industry has developed well. However, the traditional packaging method has many disadvantages, so that the packaging products lag far behind modern logistic transport industry.

Referring to FIG. 1A and FIG. 1B, a traditional packaging box being made of corrugated paper is illustrated. The packaging box has four end-to-end side walls 1*a*, 1*b*, 1*c* and 1*d* to form a containing cavity 11P. The containing cavity 11P is used to store an item. Each side wall extends upwardly and downwardly to from two foldable planes. The foldable planes can be folded to seal a top opening and a bottom opening of the containing cavity 11P.

Before being used, the packaging box can be folded, so as to be stored in a folded state, so as to decrease the space being used to store the packaging box; while the packaging box being used, the containing cavity 11P can be formed via a manual operation. The bottom opening can be sealed by the foldable planes at the bottom. After the item is put into the containing cavity, each plane at the top can be folded to seal the top opening of the packaging box, so as to finish the packaging operation.

Although the volume of the packaging box can be compressed in a folding manner before being used, due to the structure of corrugated paper and the property of the packaging box, the packaging box still occupy much storage space. In addition, the packaging box is heavy, so that the transportation cost and the use cost of the packaging box is high. Furthermore, it takes much manpower and much time to unfold the packaging box, so that the use cost of the packaging box become higher.

Along with continuous development of the logistic transport industry, more and more products need to be transported, so the quantity of the packaging box being consumed is increased. However, because of the material of the packaging box is mainly corrugated paper, the large consumption of the packaging box will necessarily bring a much heavy pressure to the environment.

What's more, during the item being transported, the packaging box cannot provide enough cushioning effect effectively. To overcome this problem, a foam cushioning element 12P matching with the packaging box and the item is needed, as can be shown in FIG. 1B. During usage, a pair of cushioning elements 12P is needed to be symmetrically provided to two sides or two ends of the item, and then the cushioning elements 12P are packaged into the containing cavity 11P, together with the item. Hence, referring to the packaging box, what is used to provide the cushioning effect is mainly the cushioning elements 12P. The packaging box plays a packaging role. However, the cushioning elements 12P are not universal. In other words, the cushioning elements 12P are only suitable to be used to an item of a predetermined type. If the item is changed, different cushioning elements need to be changed. In addition, the volume of the cushioning elements 12P is big, and cannot be changed, so the use cost of the cushioning elements 12P is higher.

In modern society, the item change with each passing day, the traditional cushioning elements 12P cannot be used as alternative packaging products for different items, so a kind of universal packaging product is necessarily needed to package items.

In addition, traditional air packaging bag forms a plurality of side walls to surround a containing space via folding and sealing an inflatable material. However, during the traditional air packaging bag being folded, some neighboring side walls cannot form a roughly right-angle shape, so the packaging bag being formed is not suitable to package rectangular item to be packaged for a big gap may be formed between the item to be packaged and the packaging bag, so the packaging bag will not tightly fit with the item to be packaged, so that the air cushioning effect is decreased.

SUMMARY OF THE PRESENT INVENTION

The invention is advantageous in that it provides a rectangular air packaging device, wherein the air packaging device provides an inflatable main body and an inflation valve. Air is inflated into the inflatable main body via the inflation valve and stored into the inflatable main body. The inflatable main body forms a plurality of side walls, so as to form a roughly rectangular packaging bag to surround around the item to be packaged. Hence, if the item to be packaged is stored in the air packaging device and when the air packaging device is being pressed in any direction, the inflatable main body is able to disperse the pressure, so that the item to be packaged will not be affected by the pressure.

Another advantage of the invention is to provide a rectangular air packaging device, while the item to be packaged is being stored in the air packaging device, the item to be packaged is substantial hanging in the air in the air packaging device, so that the item to be packaged will not be affected by the outer environment.

Another advantage of the invention is to provide a rectangular air packaging device; the air packaging device uses air as a filler, so as to decrease the weight and use cost of the air packaging device. When a pressure is applied to the air packaging device in any direction, the air in the inflatable main body can be dispersed rapidly, so as to enhance the cushioning effect of the air packaging device, so as to prevent the item to be packaged from being extruded.

Another advantage of the invention is to provide a rectangular air packaging device, while air is inflated into the inflatable main body via the inflation valve, the inflatable main body forms a plurality of side walls and a containing cavity being used to provide a containing space for the item to be packaged by means of folding along the sealing positions, so that the usage of the air packaging device is convenient.

Another advantage of the invention is to provide a rectangular air packaging device, before being inflated with air, the air packaging device occupies a little space. Comparing with the traditional packaging box, it is easy to transport and to store the air packaging device. In addition, the inflatable main body of the air packaging device can be inflated at the packaging state and can be immediately used to package the item to be packaged, so that the usage is convenient.

Another advantage of the invention is to provide a rectangular air packaging device, wherein after the air packaging device being inflated, the inflatable main body can be adjusted according to the shape of the item, so that the air packaging device is more universal. After the item to be packaged being put into the containing cavity formed by the inflatable main body, the air packaging device fits with the item to be packaged tightly, so the item to be packaged will not slip out of the containing cavity of the air packaging device.

Another advantage of the invention is to provide a rectangular air packaging device. The air packaging device not only can be used to package item to be packaged independently, but also can be used together with other packaging products, such as traditional packaging boxes.

Another advantage of the invention is to provide a rectangular air packaging device, wherein the inflatable main body of the air packaging device is inflated via one or more non-return inflation valves. While the inflation is finished, the pressure in the inflatable main body reaches to a predetermined value, so that the inflation valve can be sealed automatically, so that the usage is convenient.

Another advantage of the invention is to provide a rectangular air packaging device, wherein an gas inflating channel of the air packaging device is sealed by two sealing films, so as to form a first sealing effect, then the gas inflating channel is sealed by the non-return sealing film, so as to form a second sealing effect, so as to prevent air bag from leaking. In other words, if the air is leaked, the air can be guided into a non-return channel formed by the non-return sealing film, so as to generate pressure supplement to further seal the gas inflating channel, so as to reinforce the sealing effect of the sealing film.

According to the present invention, the foregoing and other objects and advantages are attained by a rectangular air packaging device, comprising at least one inflatable main body and at least one inflation valve, wherein the inflatable main body comprises a plurality of inflation units, wherein each inflation unit has an inflation chamber, wherein the inflation valve communicates with the inflation chamber, so as to inflate into the inflation unit, wherein the inflation unit is bended and heat-sealed to form a plurality of side walls, wherein two neighboring side walls are substantially arranged to define a right angle, so that the side walls form a rectangular containing cavity to contain an item to be packaged, so as to provide an air cushioning effect for the item to be packaged.

Preferably, the inflation units of the inflatable main body are bended, so that each the inflation unit forms a plurality of sub-inflation units, wherein a portion of the sub-inflation units are un-inflatable for being sealed via a sealing seam, so as to form at least one adjusting portion, so that two neighboring side walls formed by the sub-inflation units, which are connected with the adjusting portion, are arranged to define a right angle.

Preferably, after the inflation units of the inflatable main body are bended, each inflation unit forms a plurality of sub-inflation units, wherein the inflation volume of a portion of the sub-inflation units is reduced via the sealing of a plurality of air rejecting seams, so as to form at least one adjusting portion easy to be bended, and the shape of which is able to be changed easily, wherein the adjusting portion is provided so that two neighboring the side walls formed by the sub-inflation units, which are connected with the adjusting portion, are arranged to define a right angle.

Preferably, the air rejecting seams seal partial areas of each sub-inflation unit of the adjusting portion, so that the partial areas are un-inflatable.

Preferably, the adjusting portion and the two neighboring side walls formed by sub-inflation units are in communication with each other.

Preferably, at least one air rejecting seam at each sub-inflation unit of the adjusting portion extends along a length direction.

Preferably, at least one air rejecting seam at each sub-inflation unit of the adjusting portion extends along a width direction.

Preferably, at least one air rejecting seam at each sub-inflation unit of the adjusting portion is inclinedly provided at each corresponding sub-inflation unit.

Preferably, the shape of at least one air rejecting seam at each sub-inflation unit of the adjusting portion is selected from the group consisting of long strip, triangle, roundness, ellipse and polygon.

Preferably, the air rejecting seams of each sub-inflation unit of the adjusting portion are arranged intervally, so as to form a plurality of secondary-inflation units communicating with each other.

Preferably, two adjusting portions are provided at corners of the rectangular air packaging device, so that the containing cavity forms inner right angles.

Preferably, the containing cavity has an opening being provided for picking out and placing in the item to be packaged, wherein two adjusting portions are provided at two opposite sides adjacent to the opening, so that at least a portion of the sub-inflation units connecting with the adjusting portions are suitable to be bended to seal the opening.

Preferably, each adjusting portion is suitable to be inserted into the containing cavity, or to extend out of the containing cavity, or to be sealed together with the side walls via a side sealing seam.

Preferably, the shape of the rectangular containing cavity is selected from the group consisting of rectangle shape and square shape.

Preferably, if the number of the inflatable main bodies is two or more, the inflatable main bodies are sealed together to form the rectangular containing cavity.

Preferably, the side walls comprise a bottom wall and four side walls, wherein the bottom wall and the side walls form the rectangular containing cavity.

Preferably, the rectangular air packaging device further comprises at least one top wall extended from the side walls.

Preferably, the rectangular air packaging device further comprises a functional layer being connected to the inflatable main body, and being provided into the rectangular containing cavity, so as to form an inner packaging layer, or being provided at an outside of the inflatable main body, so as to form an outer packaging layer.

Preferably, the side walls comprises a bottom wall, a front side wall, a rear side wall, a left side wall and a right side wall, wherein the front side wall and the rear side wall and the bottom wall are formed by bending the inflation units, wherein the left side wall and the right side wall are formed respectively via sealing side edges of two sets of sub-inflation units by a side sealing seam, wherein each of the left side wall and the right side wall is sealed together with the bottom wall by a jointing seam, so that an adjusting portion is not necessary to form the rectangular containing cavity.

Preferably, at least one set of sub-inflation units of the left side wall and the right side wall communicates with the sub-inflation unit of the front side wall or right side wall formed by bending the inflation units of the front side wall or right side wall via a plurality of communicating channels.

Preferably, the inflation unit of the bottom wall forms inflatable sub-inflation units between the sealing seam and the inflation valve via seal seams, other parts forms at least one inflation unit, wherein the edges of the un-inflation unit and the sub-inflation unit are heat sealed by an end sealing seam, so as to form a bottom sealing structure. Preferably, the inflatable main body comprises a first chamber layer and a second chamber layer, the first chamber layer and the second chamber layer overlap with each other and form each inflation unit via a sealing technology, wherein the inflation chamber of the inflation unit is provided with one or more the inflation valves, wherein after the inflation via the inflation valve is finished, and the pressure in the inflation chamber reaches to a predetermined value, the inflation valve seals itself, so as to prevent gas from being leaking.

Preferably, the inflation valve comprises two valve films being respectively heated together with the first chamber layer and the second chamber layer of the inflation unit of the inflatable main body, wherein a gas inflating channel is formed between the two valve films, wherein while inflating the inflation unit via the gas inflating channel, inner surfaces of the two valve films adhere to each other automatically, so as to prevent the gas entered into the inflation unit from being leaking from the gas inflating channel.

Preferably, the inflation valve is a self-adhesive non-return valve comprising a first valve film, a second valve film, and a non-return sealing film.

In accordance with another aspect of the invention, the present invention comprises a rectangular air packaging device comprising at least one inflatable main body and at least one inflation valve. The inflatable main body comprises a plurality of inflation units. Each inflation unit has an inflation chamber. The inflation valve communicates with the inflation chamber, so as to inflate the inflation unit. After being bended and heat-sealed, each inflation unit forms a plurality of sub-inflation units. The sub-inflation units form a plurality of side walls. The area of each side wall is the same, so that the side walls are suitable to form a square containing cavity to contain an item to be packaged, so as to provide air cushioning effect to the item to be packaged.

Preferably, the size and number of each sub-inflation unit of each side wall is the same.

Preferably, each side wall has 3~100 sub-inflation units.

Preferably, the plurality of side walls comprises at least one bottom wall and four side walls. The bottom wall and the side walls form the square containing cavity.

Preferably, the square containing cavity further has an opening being used for picking out- and placing the item to be packaged. The rectangular air packaging device further comprises at least one top wall connected to the side walls, so as to seal the opening.

Preferably, after the inflation units are divided to the sub-inflation unit, a portion of the sub-inflation units form adjusting portions, other sub-inflation units are used to form the side walls. The adjusting portions are suitable to be folded, so that the square containing cavity defined by the side walls has an inner right-angle structure.

Preferably, the sub-inflation units each of the adjusting portions are sealed by sealing seams, so as to form an un-inflatable structure.

Preferably, the sub-inflation units of the adjusting portion are provided with air rejecting seams, so as to reduce the inflation volume of the sub-inflation units, so that the whole adjusting portion is suitable to be folded.

Preferably, the rectangular air packaging device further comprises a functional layer connected to the inflatable main body, and provided into the rectangular containing cavity to form an inner packaging layer, or provided at an outside of the inflatable main body so as to form an outer packaging layer.

Preferably, the inflation unit comprises a first chamber layer and a second chamber layer, the overlapped first chamber layer and second chamber layer forms each inflation unit by a sealing technology, wherein the inflation chamber of each inflation unit has one or more inflation valves. After the inflation via the inflation valve is finished, the pressure in the inflation chamber reaches to a predetermined value, the inflation valve seals itself, so as to prevent gas from being leaking.

Preferably, the inflation valve comprises two valve films being respectively heat-sealed together with the first chamber layer and the second chamber layer of the inflation unit of the inflatable main body. A gas inflating channel is formed between the two valve films. After gas is inflated to the inflation unit through the gas inflating channel, inner surfaces of the two valve films adhere to each other automatically, so as to prevent the gas entered into the inflation unit from leaking through the gas inflating channel.

Preferably, the inflation valve is self-adhesive non-return valve comprising a first valve film, a second valve film and a non-return sealing film.

Additional advantages and features of the invention will become apparent from the description which follows, and may be realized by means of the instrumentalities and combinations particular point out in the appended claims.

In accordance with another aspect of the invention, the present invention comprises a manufacturing method of a rectangular air packaging device comprising the following steps:

(a) overlapping a first chamber layer, valve films of an inflation valve and a second chamber layer together;

(b) forming at least one inflatable main body via a heat-sealing technology, wherein the inflatable main body comprises one or more inflation units each having an inflation chamber, wherein the inflation valve communicates with the inflation chamber, so as to inflate the inflation chamber; and (c) bending each the inflation unit to form a plurality of sub-inflation units, wherein a portion of the sub-inflation units form at least one adjusting portion, wherein the rest sub-inflation units form a plurality of side walls, wherein the side walls are suitable to form a rectangular containing cavity to package an item to be packaged.

Preferably, in step (c), be means of a sealing seam via heat-sealing, the sub-inflation units of the adjusting portion are un-inflatable.

Preferably, in step (c), by means of air rejecting seams via heat-sealing, the inflation volume of the sub-inflation units of the adjusting portion is reduced.

Preferably, two adjusting portion are respectively provided at the corners of the rectangular air packaging device.

Preferably, the containing cavity has an opening being used for picking out and placing in the item to be packaged, wherein the adjusting portions are provided at two opposite sides adjacent to the opening.

Preferably, the manufacturing method of the rectangular air packaging device further comprises a step of connecting two or more inflatable main bodies together via end sealing seams, so as to form the rectangular containing cavity.

Preferably, the manufacturing method of the rectangular air packaging device further comprises a step of communicating a portion of neighboring inflation units via communicating channels.

Preferably, the manufacturing method of the rectangular air packaging device further comprises a step of sealing side edges of two sets of the sub-inflation units of at least one side wall via a side sealing seam.

Preferably, the manufacturing method of the rectangular air packaging device further comprises a step of connecting a functional layer to the inflatable main body, so as to form an inner bag or an outer bag.

Preferably, the inflation valve comprises two valve films respectively heat-sealed together with the first chamber layer and the second chamber layer of the inflation unit of the inflatable main body, wherein a gas inflating channel is formed between the two valve films, wherein after inflating the inflation unit via the inflating channel, inner surfaces of the two valve films adhere to each other automatically, so as to prevent the gas entered into the inflation unit from leaking through the air inflating channel.

Preferably, the inflation valve is a self-adhesive non-return valve comprising a first valve film, a second valve film and a non-return sealing film.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
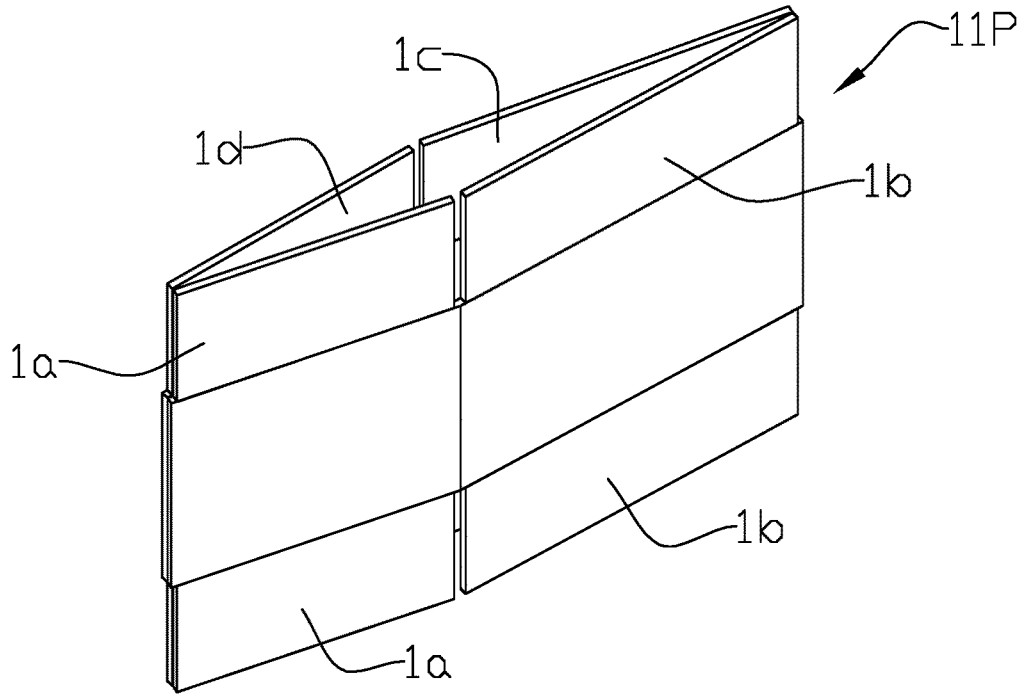
FIG. 1A and FIG. 1B are schematic views of a traditional packaging box.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 2 to 5B, a rectangular air packaging device according to a first preferred embodiment of the present invention is illustrated. During being inflated and after being inflated, the air packaging device can form a plurality of side walls to surround an item to be packaged. While the item to be packaged is being placed into the air packaging device and the air packing device is bearing a press from any direction, the pressure applied to the air packaging device can be dispersed, so as to prevent the item to be packaged from being damaged.

Accordingly, the air packaging device comprises an inflatable main body 10, and one or more inflation valves 20. The inflation valve 20 is used to inflate gas into the inflatable main body 10. The inflatable main body 10 can store gas after the inflation is finished.

According to this preferred embodiment of the present invention, the inflatable main body 10 comprises one or more inflation units 11, wherein each inflation unit 11 comprises a first chamber layer 101 and a second chamber layer 102. The first chamber layer 101 and the second chamber layer 102 overlap with each other to form an inflation chamber 12 and an air inflating opening 13, wherein the inflation chamber 12 communicates with the air inflating opening 13.

Each inflation valve 20 is provided at each air inflating opening 13 formed by the overlapped first chamber layer 101 and second chamber layer 102. Each inflation valve 20 communicates with each inflation chamber 12, so that each inflation chamber 12 of the air packaging device can be inflated with gas via each inflation valve 20. In addition, after the inflating process via each inflation valve 20 is finished, the pressure in each inflation chamber 12 reaches to a predetermined value, so that each inflation valve 20 can be sealed automatically, so as to prevent the gas in each inflation chamber 12 leaking through each inflation valve 20, so as to ensure the reliability of the air packaging device, during being used.

Two sides of each inflation unit 11 respectively has a sealing side wall 103, the sealing side wall 103 between each two neighboring inflation units 11 is formed by a long and narrow dividing seam 104. In other words, the dividing seam 104 connects the inflatable main body 10 in a heat sealing manner so as to form the inflation units 11. Preferably, the inflation units 11 are arranged side by side to form the inflatable main body 10. It is worth mentioning that, the inflation units 11 roughly parallel with each other, so that the shape of the inflatable main body 10 is settled and can be easily controlled during being produced.

It is worth mentioning that during the air packaging device being fashioned, each dividing seam 104 is formed by sealing the first chamber layer 101 and the second chamber layer 102. Particularly, according to this preferred embodiment of the present invention, each dividing seam 104 is formed by heat seal the first chamber layer 101 and the second chamber layer 102 by a heat sealing technology. At the position of the first chamber layer 101 and the second chamber layer 102, where overlapping with the inflation valve 20, the first chamber layer 101 and the second chamber layer 102 are further heat sealed to valve films of the inflation valve 20. One skilled in the art will understand that during sealing the first chamber layer 101 and the second chamber layer 102, the sealing technology is not limited to the heat sealing technology. The method of forming each dividing seam 104 by sealing the first chamber layer 101 and the second chamber layer 102 is applied, so that each inflation unit 11 can form a single inflation chamber 12. In addition, the position and number of each dividing seam 104 can be adjusted according to different requirements, so that air packaging devices with different shapes and standards can be formed by the inflatable main body 10, so as to satisfy different using requirements.

One skilled in the art will understand that each inflation chamber 12 can be inflated with gas and can store gas independently via each inflation valve 20. If each one of the inflation chambers 12 is damaged or leaks, the neighboring inflation chamber 12 still full of gas. Hence, during the air packaging device packaging the item to be packaged, the probability of the item to be packaged being damaged can be reduced, so that the reliability of the air packaging device can be protected effectively.

Figure 3:
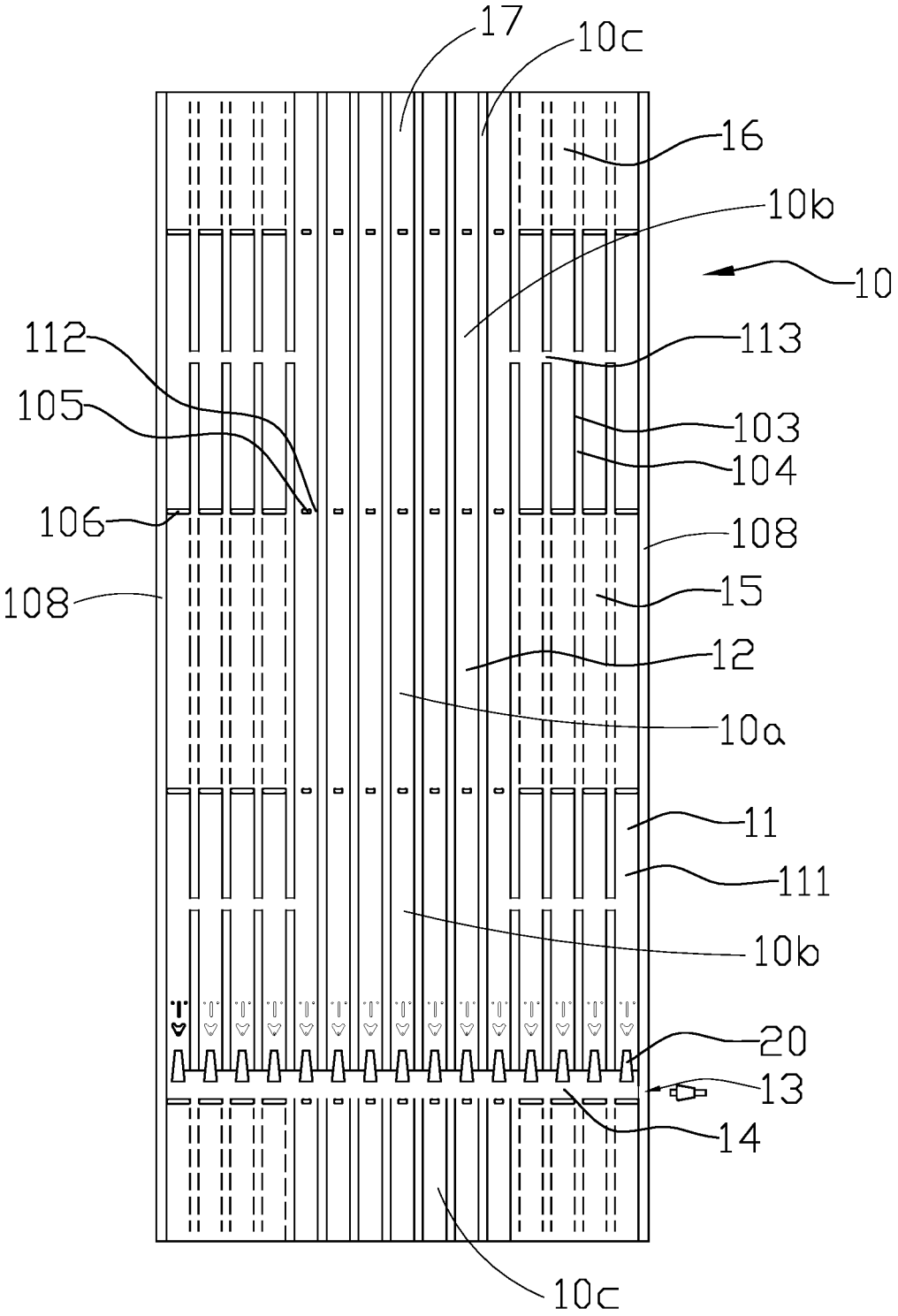
FIG. 3 is a perspective view of the rectangular air packaging device according to the above first preferred embodiment of the present invention, illustrating an unfolded structure of the rectangular air packaging device.
Figure 4:
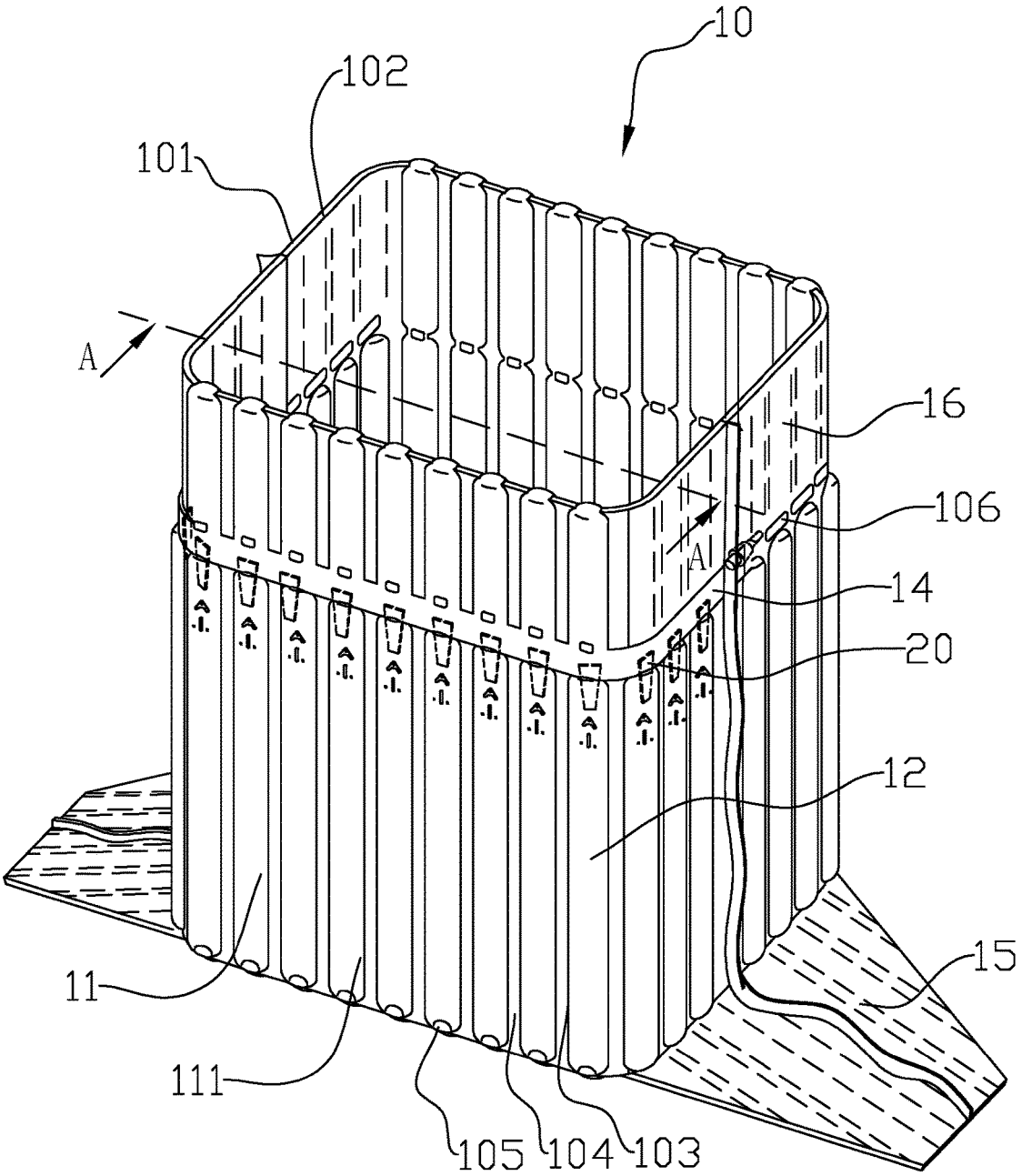
FIG. 4 is a perspective view of the rectangular air packaging device according to the above first preferred embodiment of the present invention, illustrating a folded structure of the rectangular air packaging device having a non-inflated structure.

According to this preferred embodiment of the present invention, referring to FIG. 3 and FIG. 4, the first chamber layer 101 and the second chamber layer 102 are overlapped with each other to form an inflating channel 14, wherein the inflating channel 14 communicates with each air inflating opening 13. It is worth mentioning that, due to each air inflating opening 13 communicates with each inflation valve 20, the inflating channel 14 communicates with each inflation valve 20.

In addition, in order to expediently inflate gas into the inflating channel 14, an inflating end of the inflating channel 14 can be selectively provided with inflating mouth or other structure which makes the inflating via inflating pump to be easy, which can be matched with the inflating pump. In this condition, users can expediently apply the inflating pump or other inflating devices to inflate gas into the inflating channel 14. Hence, the inflating device being used in this preferred embodiment is not limitation to the present invention. After gas being inflated into the inflating channel 14, the gas can be distributed to each communicated inflation valve 20 through the inflating channel 14, and the gas enters into each inflation chamber 12, through each inflation valve 20. After the inflation is finished and the pressure in each inflation chamber 12 reaches to a predetermined value, each inflation valve 20 can be sealed automatically, so as to prevent the gas in each inflation chamber 12 from leaking from each inflation valve 20, so that it is realized to inflate into the inflatable main body 10 via each inflation valve 20.

One skilled in the art will understand that during inflating gas into the inflatable main body 10, the inflating channel 14 can distribute gas to each inflation valve 20, and the gas can be inflated into the inflating channel 14, so as to realize inflating gas into the inflatable main body 10. Hence, according to the function of the inflating channel 14, the inflating channel 14 is a gas distributing channel. However, one skilled in the art will understand that, if the air packaging device doesn't provide the inflating channel 14, gas can be independently inflated into each inflation chamber 12 via each inflation valve 20.

It is worth mentioning that the inflation chambers 12 can communicate with each other, so that it can be realized to inflate gas into all of the inflation chambers 12 via only one inflation valve 20.

According to this preferred embodiment of the present invention, the first chamber layer 101 and the second chamber layer 102 are selectively sealed to form one or more bending seams 105. The bending seam 105 is provided, so that each inflation unit 11 forms a plurality of sub-inflation unit 111 communicating with each other. Two ends of each bending seam 105 are not extended to each sealing side wall 103 being used to form each inflation chamber 12. In other words, a communicating channel 112 is form between one end of each bending seam 105 and each dividing seam 104, so as to communicate each two neighboring sub-inflation units 111. In this way, during a sub-inflation unit 111 of the inflation unit 11 being inflated with gas, the gas enters into all of the sub-inflation units 111 of the inflation units 11 through each communicating channel 112 at two sides of the bending seam 105, so as to realize the purpose of inflating the inflation unit 11. In other words, each sub-inflation unit 111 of one inflation unit 11 can be inflated via each communicating channel 112. In addition, the communicating channel 112 can be provided at the middle part of the inflation unit 11. For example, the communicating channel 112 can be formed between two neighboring bending seams 105 along the width direction of the inflation unit 11. The two neighboring bending seams 105 along the width direction of the inflation unit 11 are respectively provided to two side portions of one inflation unit 11.

Figure 2:
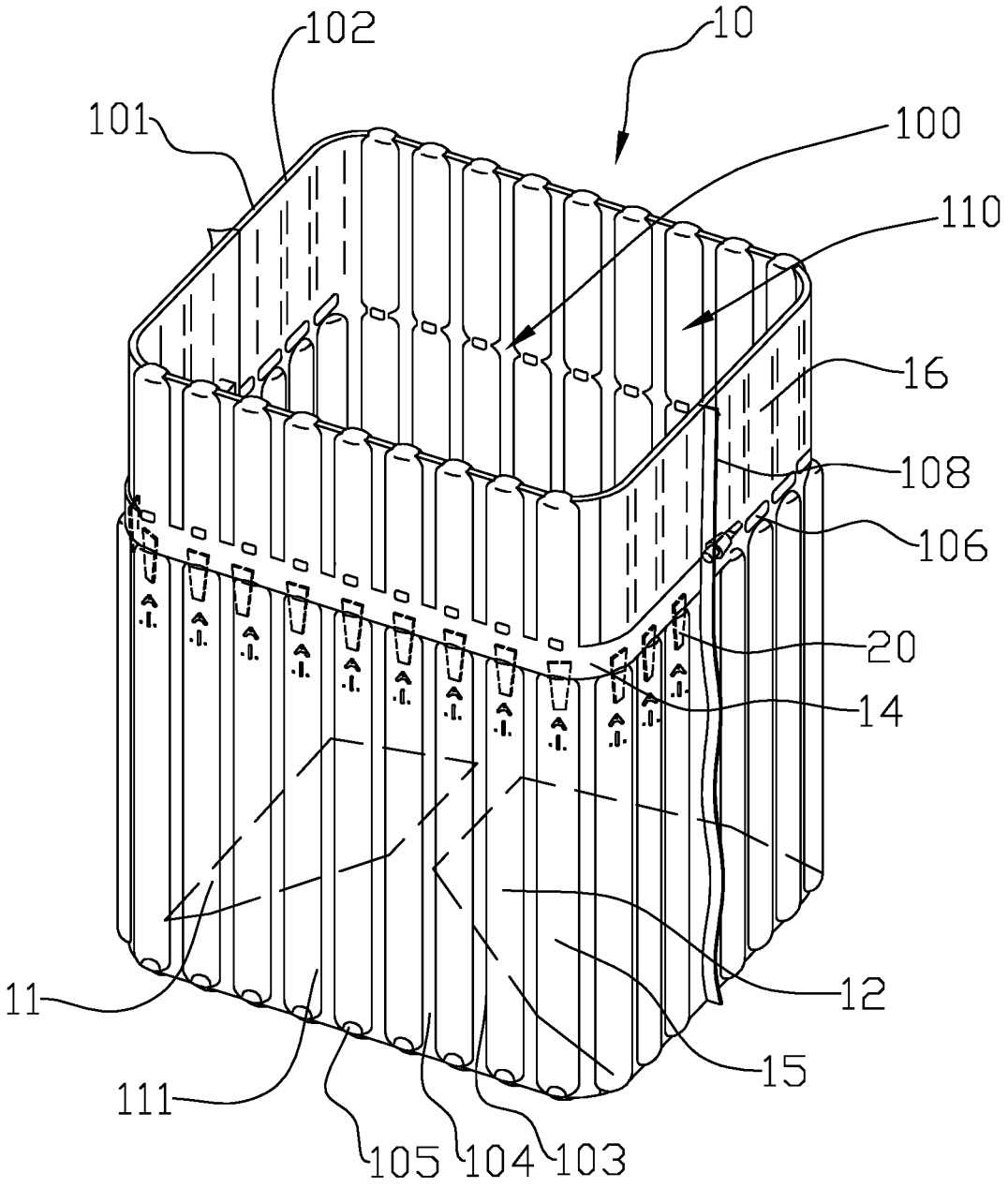
FIG. 2 is a perspective view of a rectangular air packaging device according to a first preferred embodiment of the present invention.

It is worth mentioning that each bending seam 105 of each inflation unit 11 is corresponding aligned in position, so as to be arranged to form a line, so that each inflation unit 11 forms each corresponding sub-inflation unit 111. In order to form the air packaging device, each inflation unit 11 of the inflatable main body 10 provides more than one line of bending seam 105. After each inflation unit 11 is filled with gas, each inflation unit 11 can be bended at the position of each bending seam 105, so as to form a plurality of side walls. Referring to FIG. 2, According to this preferred embodiment of the present invention, each inflation unit 11 is bended at the position of each bending seam 105, so that the air packaging device formed by the sub-inflation units 111 has a bottom wall 10*a*, four side walls 10*b* and a top wall 10*c*. The bottom wall 10*a*, the four side walls 10*b* form a containing cavity 100 and an opening 110. The item to be packaged can be put into the containing cavity 100 via the opening 110, and then the opening 110 can be sealed by the top wall 10*c*, so that the work of item to be packaged can be finished.

It is worth mentioning that, the position of the bending seam 105 and the number of the lines of the bending seam 105 can be adjusted, so that the inflatable main body 10 can form air packaging devices with different shape and size, so as to satisfy the different requirements of the users.

It is worth mentioning that the heat sealing technology is applied, so that the inflatable main body 10 forms a planar cushioning material. A spatial configuration formed by the planar cushioning material is heat sealed, so that the inflatable main body 10 forms the air packaging device having the containing cavity 100 for item to be packaged. After the air packaging device is formed, the shape of each inflation unit 11 can be changed via bending, so that the air packaging device can match different item to be packaged with different sizes, so that the air packaging device has good universality. In addition, after the item to be packaged being packaged in the containing cavity 100 of the air packaging device, the air packaging device combines with item to be packaged tightly, so the item to be packaged will not slip out of the containing cavity 100 of the air packaging device.

Referring to FIG. 3 and FIG. 4, a predetermined number of continuous inflation units 11 at two sides of the inflatable main body 10, such as four inflation units as illustrated in FIG. 3, are provided with sealing seams 106. Each sealing seam 106 is formed by sealing the first chamber layer 101 and the second chamber layer 102 via a heat sealing technology. According to this preferred embodiment of the present invention, the position of each sealing seam 106 corresponds with the position of each bending seam 105, thus after each inflation unit 11 of the inflatable main body 10 is inflated with gas, each sealing seam 106 makes the air packaging device to form un-inflatable structures 15 at a corresponding position, such as the connecting position of the four side walls and the bottom wall. In this manner, when inflating gas into each inflation unit 11 of the inflatable main body 10, the inflatable main body 10 forms the bottom wall 10*a*, the four side walls 1*b* and the top wall 10*c* automatically, so as to form the containing cavity 100 automatically. In this condition, the un-inflatable structures 15 are provided to the corners of the air packaging device, so that the existence of the un-inflatable structures 15 will not affect the using effect of the air packaging device. It is worth mentioning that, due to the un-inflatable structures 15 are formed, the sub-inflation units 111 forming the side walls, which is provided to two sides of the un-inflatable structures 15 in the lengthen direction, cannot be inflated, as can be shown in FIG. 3. These sub-inflation units 111 can be provided with communicating channel 113, so as to communicate with other inflation units 11 without the sealing seam 106, so that during the inflating process, while other inflation unit 11 being inflated, the communicating channels 113 can be used to inflate the sub-inflation units 111.

Figure 9A:
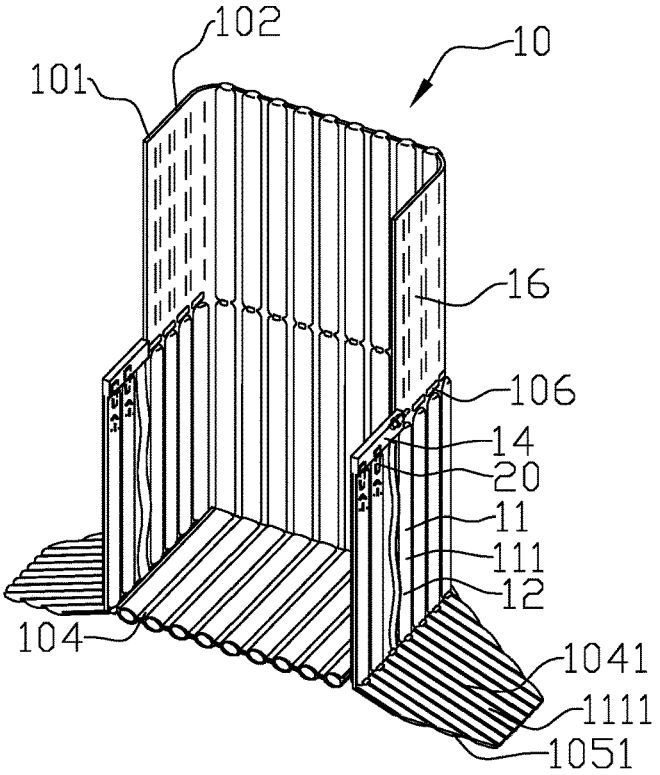
FIG. 9A and FIG. 9B are respectively schematic views along line B-B of FIG. 7.
Figure 9B:
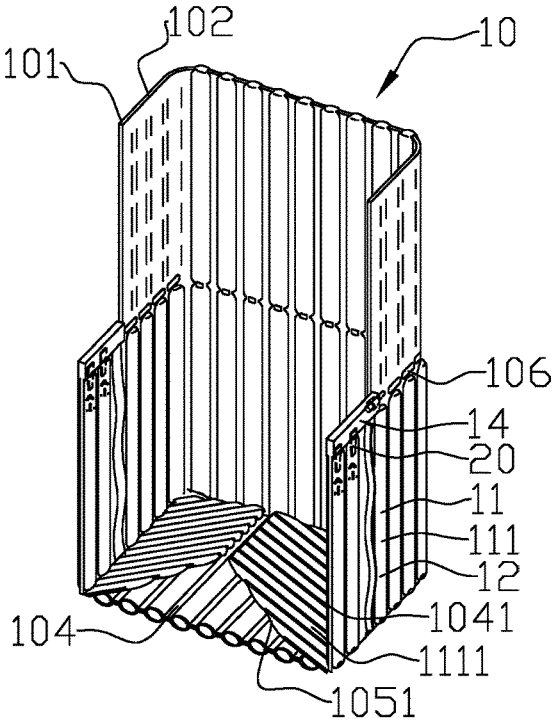
Figure 9C:
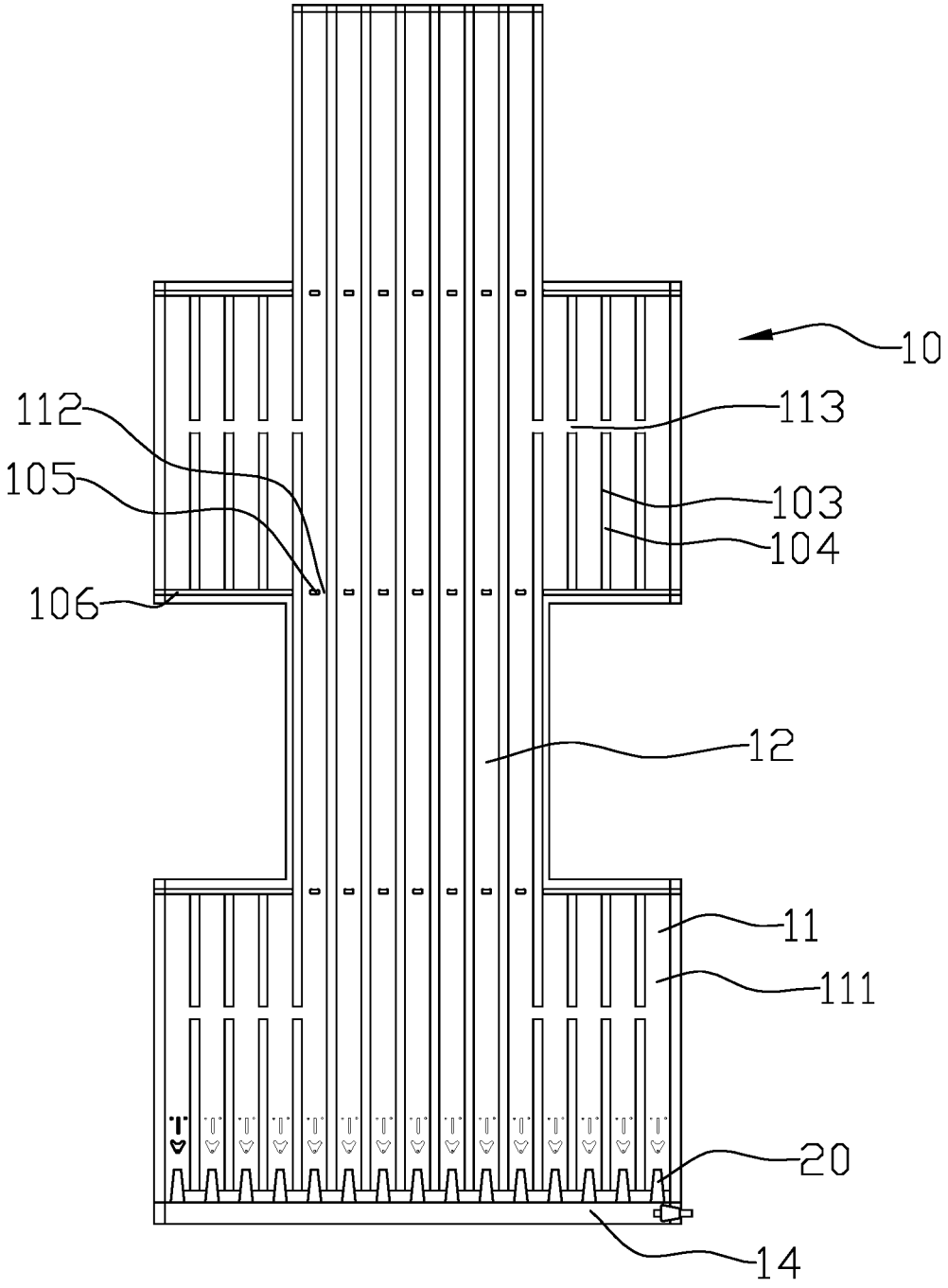
FIG. 9C and FIG. 9D are schematic views of an alternative mode of the present invention.
Figure 9D:
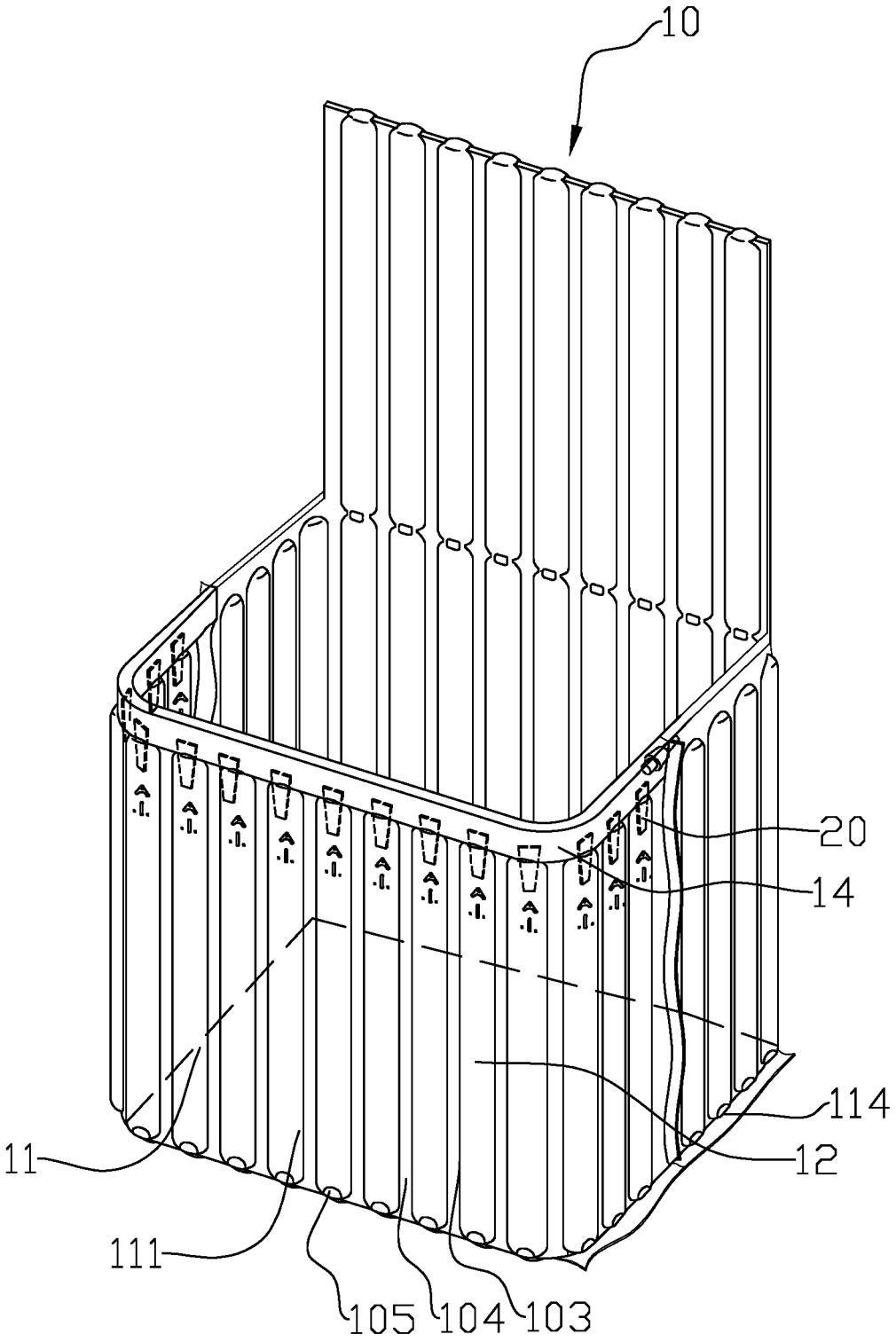

In addition, referring to FIGS. 9C and 9D, a rectangular air packaging device according to an alternative mode is illustrated, wherein the un-inflatable structure 15 is not provided. The inflatable main body 10 is directly connected together via jointing seams 114, so as to form the containing cavity. In detail, the left side wall and the right side wall are respectively jointed together with the side edge of the bottom wall 10*a* via the jointing seams 114, and two sets sub-inflation units 111 of the left side wall and the right side wall are jointed together.

In addition, referring to FIG. 2 and FIG. 3, two ends of the inflatable main body 10 are respectively sealed by two sealing seams 106, so that after each inflation unit 11 of the inflatable main body 10 is inflated with gas, the symmetry portions of the top wall formed by the inflatable main body 10 form un-inflatable portions 16, so that the top wall 10*c* formed by each sub-inflation unit 11 can easily close the opening 110. In other words, the top wall 10*c* comprises at least one inflatable structure 17 and the un-inflatable portions 16 connecting with the inflatable structure 17. If a press is applied to the inflatable structure 17, the inflatable structure 17 makes the un-inflatable portions 16 to be folded to enter into the containing cavity 100. The inflatable structure 17 can seal the opening 110.

Figure 5A:
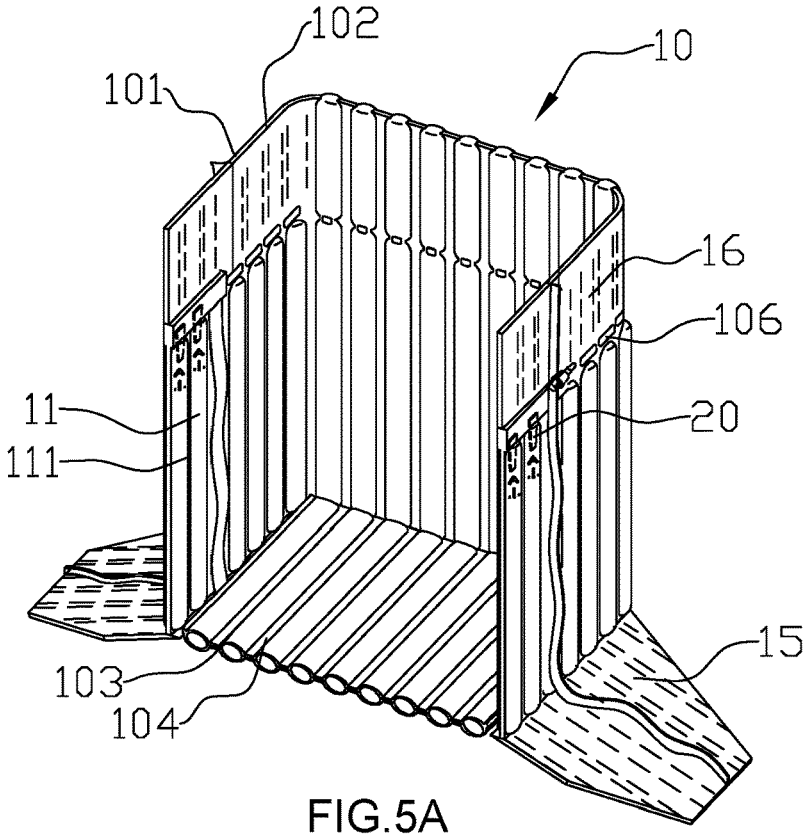
FIG. 5A and FIG. 5B are respectively schematic views along line A-A of FIG. 4.
Figure 5B:
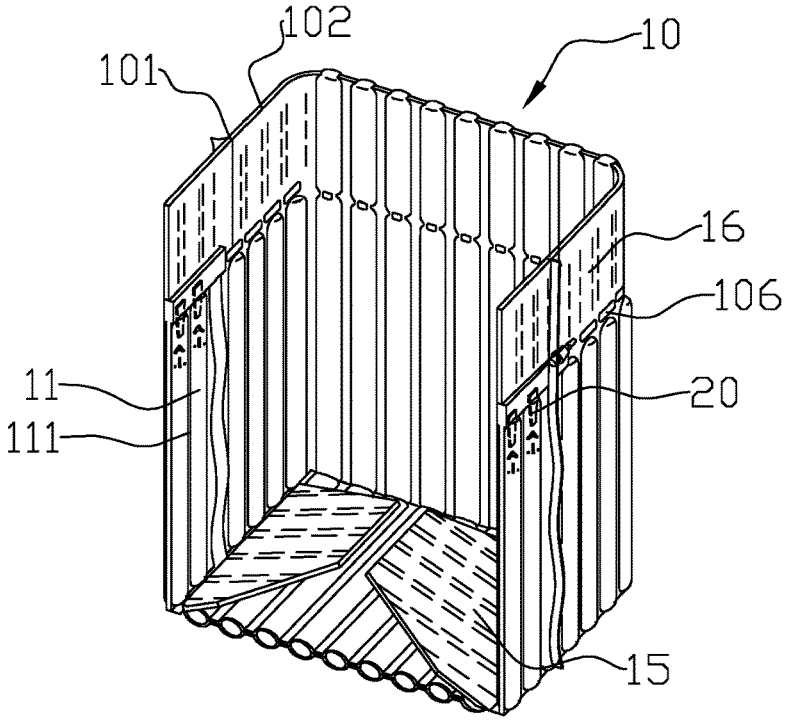
Figure 6:
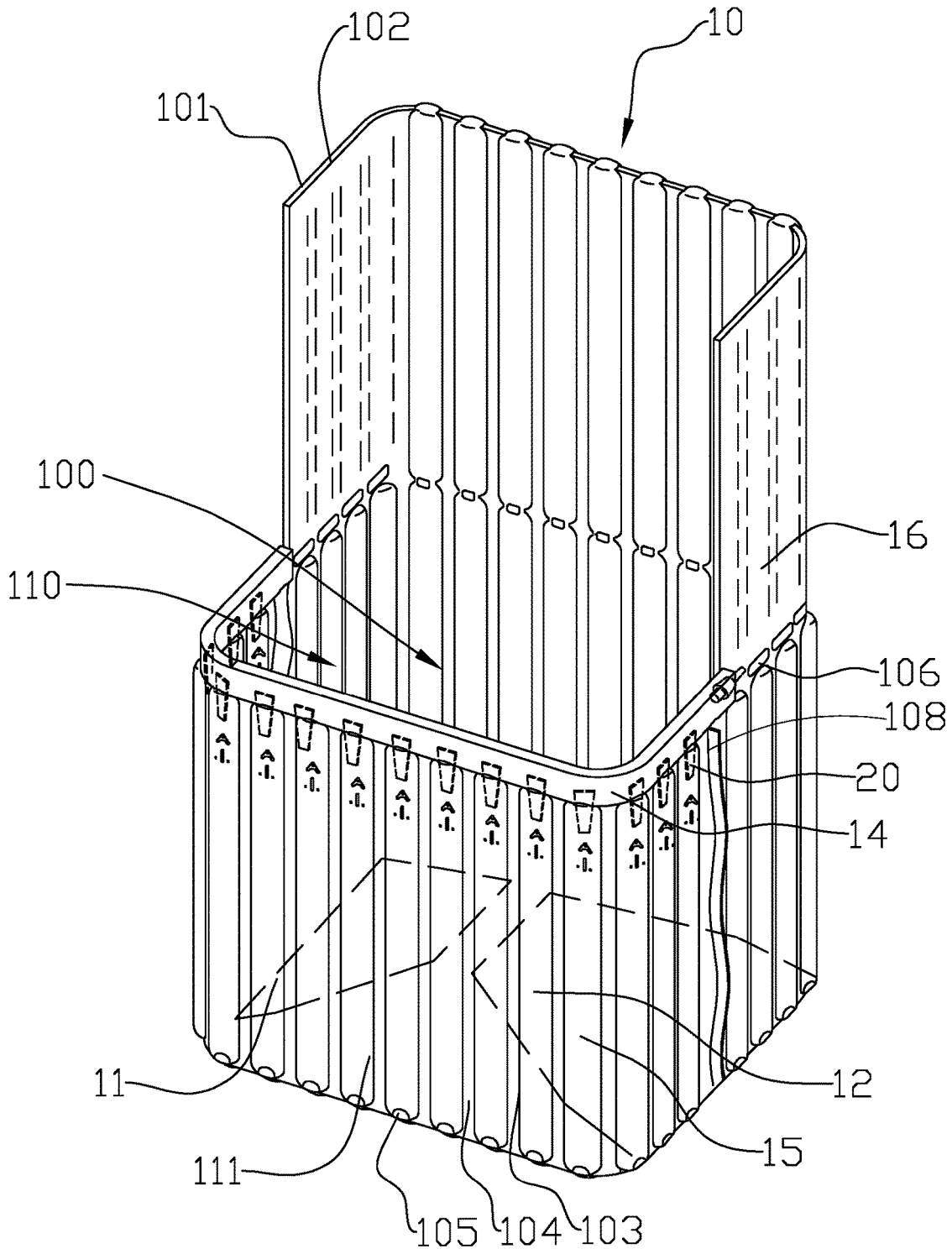
FIG. 6 is a perspective view of a rectangular air packaging device according to a second preferred embodiment of the present invention.
Figure 7:
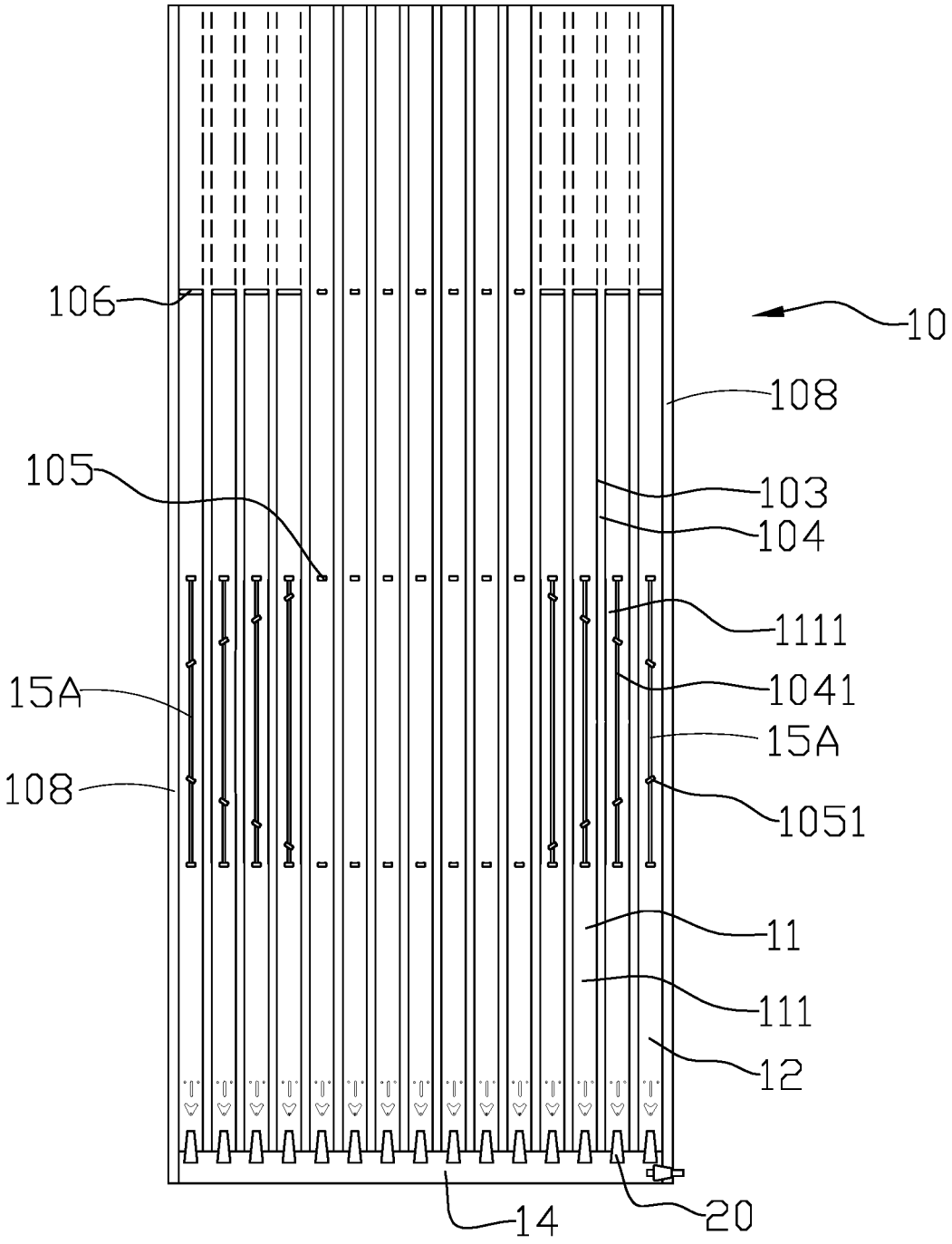
FIG. 7 is a perspective view of the rectangular air packaging device according to the above second preferred embodiment of the present invention, illustrating an-unfolded structure of the rectangular air packaging device.
Figure 8:
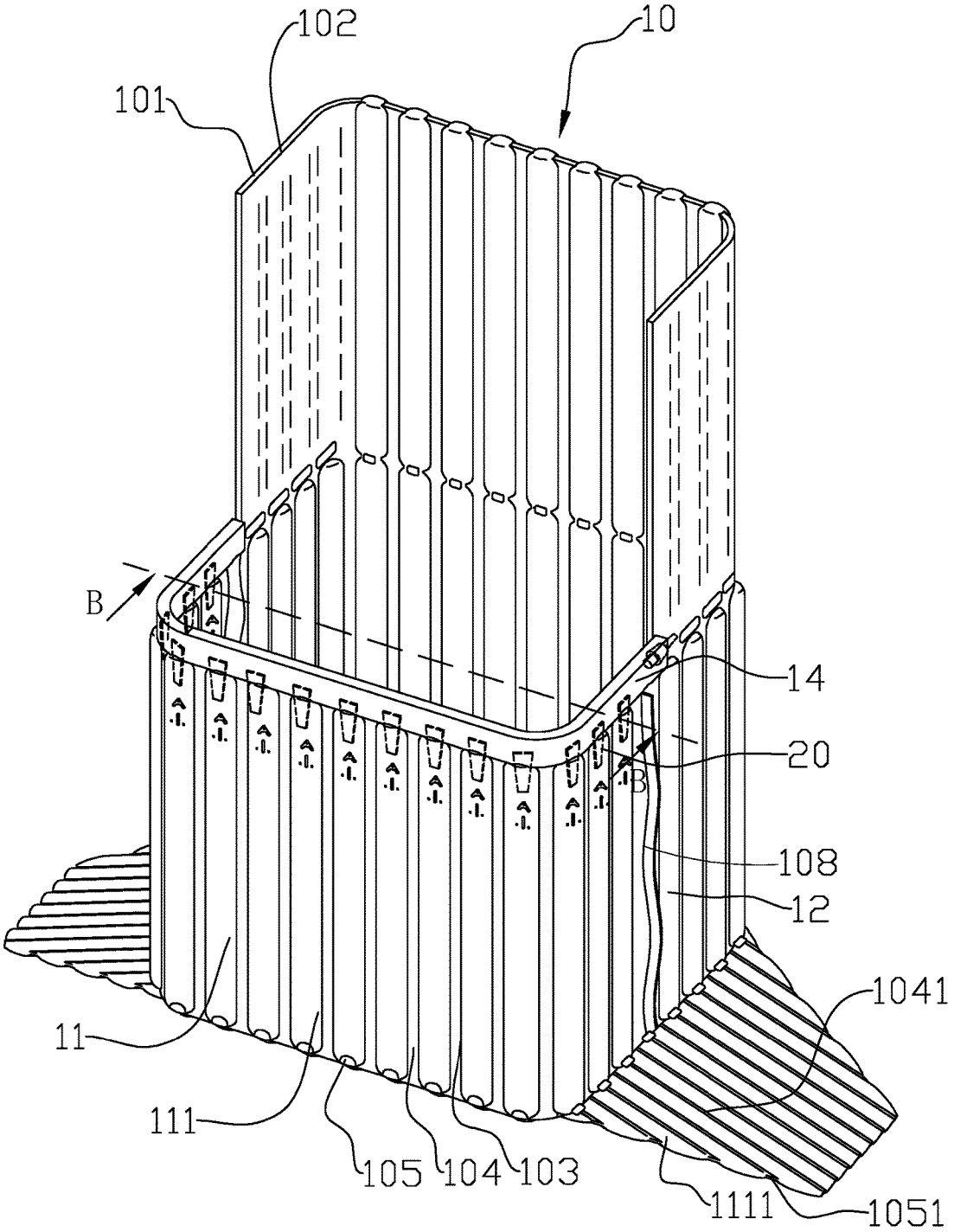
FIG. 8 is a perspective view of the rectangular air packaging device according to the above second preferred embodiment of the present invention, illustrating a non-inflated structure of the rectangular air packaging device having sub-inflatable main bodies.

Referring to FIG. 5A and FIG. 5B, after the air packaging device being inflated, each un-inflatable structure 15 can be adhered to the bottom wall or the four side walls of the air packaging device, or can be inserted into the containing cavity 100 of the air packaging device through the gap between the bottom wall and the four side walls. Accordingly, after the top wall seals the opening 110, the un-inflatable portion 16 can be adhered to the outer surface of the inflatable structure 17 of the top wall 10*c*, or can be inserted into the containing cavity of the air packaging device.

It is worth mentioning that, after each un-inflatable structure 15 and each un-inflatable portion 16 are inserted into the containing cavity of the air packaging device, the outer surface of the air packaging device becomes tidier, so that the transition of the air packaging device is simple.

It is worth mentioning that, each dividing seam 104, each bending seam 105 and each sealing seam 106 are formed by heat sealing the first chamber layer 101 and the second chamber layer 102 via heat sealing. But it is not limited to heat-sealing technology to achieve the purpose of forming each dividing seam 104, each bending seam 105 and each sealing seam. One skilled in the art will understand that other technologies, such as bonding by glue is also feasible.

The seams 105, 106, 107 and other seams such as borderline seams make the inflatable main body 10 form a planar cushioning material, i.e. the seams belong to first sealing seams. In a secondary sealing technology, the planar cushioning material is bended and sealed via secondary sealing seams, such as side sealing seams 108 illustrated in FIG. 2, to form the three-dimensional air packaging device with the containing cavity 100. The sub-inflation units 111 at two sides of the un-inflatable portion 15 in the length direction are sealed together, so as to form the left side wall and the right side wall of the four side walls of the air packaging device. In other words, the left side wall or the right side walls are respectively formed by two parts of heat-sealing. Along the length direction of the inflatable main body 10, the sub-inflation units 111 at two sides of the bottom wall 10*a* form the front wall and the rear side wall of four side walls. The un-inflatable structure 15 and un-inflatable portion 16 almost form adjusting portions 15 and 16 of the whole air packaging device, so that the inflatable main body 10 is suitable to form the roughly rectangular containing cavity 100 after being inflated.

Figure 1B:
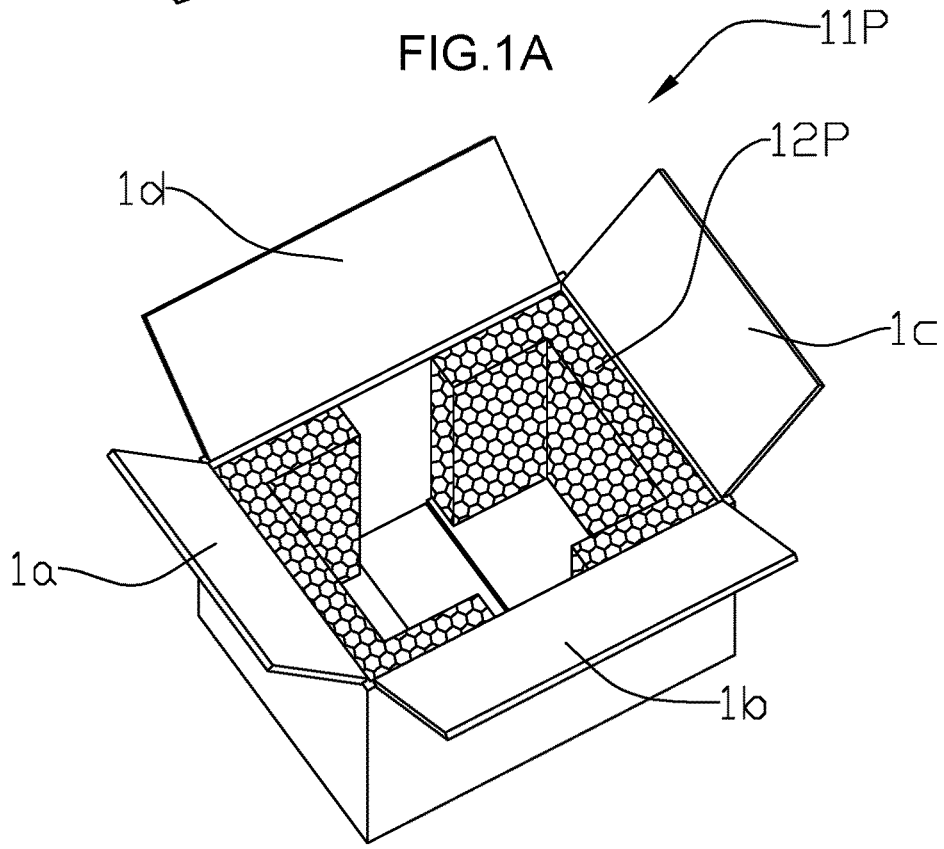

According to this preferred embodiment of the present invention, the air packaging device not only can be used to package item to be packaged independently, but also can be used with other packaging materials, such as the traditional packaging box illustrated in FIG. 1A and FIG. 1B. In this condition, firstly, item to be packaged are put into the containing cavity formed by the air packaging device during being inflated, and then the air packaging device is put into the packaging box.

Referring to FIGS. 6 to 9B, a rectangular air packaging device according to a second preferred embodiment of the present invention is illustrated. According to this preferred embodiment of the present invention, the first chamber layer 101 and the second chamber layer 102 are selectively partial sealed to form one or more bending seams 105. Each bending seam 105 is provided, so that each inflation unit 11 forms a plurality of sub-inflation unit 111 communicating with each other. Two ends of each bending seam 105 have not extended to each dividing seam 104 which is used for forming the inflation chamber 12. Hence, a plurality of communicating channel 112 is formed. Each communicating channel 112 is formed between each bending seam 105 and each dividing seam 104, so as to communicate each two neighboring sub-inflation units 111. In this way, during a sub-inflation unit 111 of the inflation unit 11 being inflated with gas, the gas enters into all of the sub-inflation units 111 of the inflation units 11 through each communicating channel 112 at two sides of the bending seam 105, so as to realize the purpose of inflating the inflation unit 11. In other words, each sub-inflation unit 111 of one inflation unit 11 can be inflated via each communicating channel 112.

It is worth mentioning that each bending seam 105 of each inflation unit 11 is corresponding aligned in position, so as to be arranged to form a line, so that each inflation unit 11 forms each corresponding sub-inflation units 111. In order to form the air packaging device, each inflation unit 11 of the inflatable main body 10 provides more than one line of bending seam 105. After each inflation unit 11 is filled with gas, each inflation unit 11 can be bended at the position of each bending seam 105, so as to form a plurality of side walls. Referring to FIG. 2, According to this preferred embodiment of the present invention, each inflation unit 11 is bended at the position of each bending seam 105, so as to form the air packaging device. The air packaging device has a bottom wall, four side walls and a top wall. The bottom wall and the four side walls respectively form a containing cavity 100 and an opening 110. The item to be packaged can be put into the containing cavity 100 via the opening 110, and then the opening 110 can be sealed by the top wall 10*c*, so that the work of item to be packaged can be finished.

Furthermore, the continuous symmetrical sub-inflation unit 111 of the inflatable main body 10 has at least one long and narrow sub-dividing seam 1041. One skilled in the art will understand that each sub-dividing seam 1041 is formed via sealing the first chamber layer 101 and the second chamber layer 102 by the heat sealing technology, so that each sub-inflation unit 111 is divided into at least two secondary-inflation units 1111 via the elongated sub-dividing seam 1041. Certainly, more than one sub-dividing seam 1041 can be provided, so that each of the sub-inflation unit 111 is further divided into more secondary inflation units 1111. The secondary inflation units 1111 form two adjusting portions, so as to form the rectangular containing cavity.

It is worth mentioning that, two ends of each sub-dividing seam 1041 are respectively extended from one e bending seam 105, so that the secondary inflation units 1111 can be communicated to the sub-inflation units 111 by the communicating channel 112. Thus, if any sub-inflation unit 111 of the inflation unit 11 is inflated with gas, all of the sub-inflation units 111 and the secondary inflation units 1111 of the inflation unit 11 can be inflated with gas.

It is worth mentioning that, the diameter of the gas column formed by each secondary inflation unit 1111 is smaller than the diameter of the gas column formed by each sub-inflation unit 111.

Furthermore, at the corresponding position of each secondary inflation unit 1111, a sub-bending seam 1051 is provided, so that after each secondary inflation unit 1111 is inflated with gas, each secondary inflation unit 1111 can bend automatically at the position of the sub-bending seam 1051, so as to assist each inflation unit 11 to form the air packaging device. One skilled in the art will understand that each sub-bending seam 1051 is formed by heat-sealing the first chamber layer 101 and the second chamber layer 102. Of course, the sub-bending seam 1051 can be connected to the corresponding sub-dividing seam 1041 so as to form an integral structure. In other words, the sub-bending seam 1051 is formed at the end of the sub-dividing seam 1041.

Figure 9E:
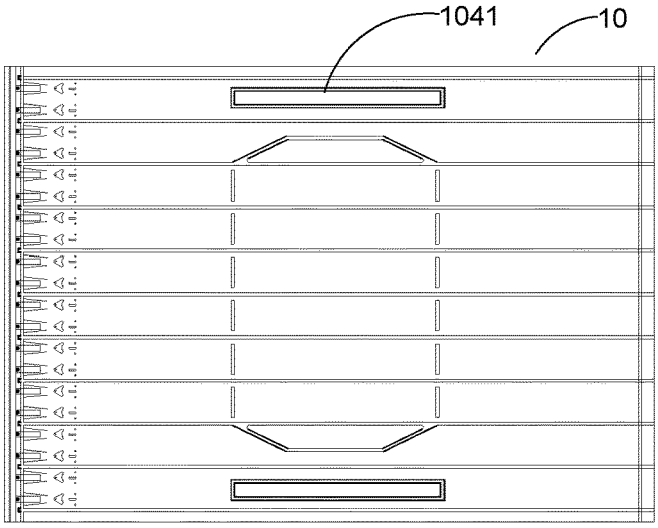
FIG. 9E is a schematic view of another alternative mode of the present invention.
Figure 10:
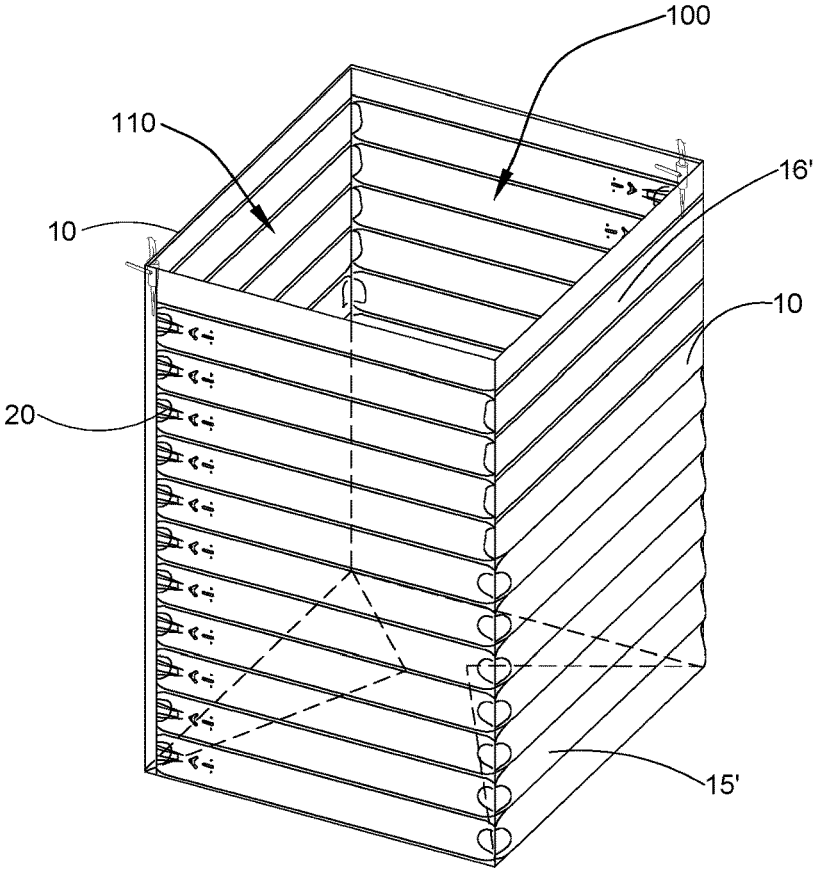
FIG. 10 is a perspective view of a rectangular air packaging device according to a third preferred embodiment of the present invention.
Figure 11:
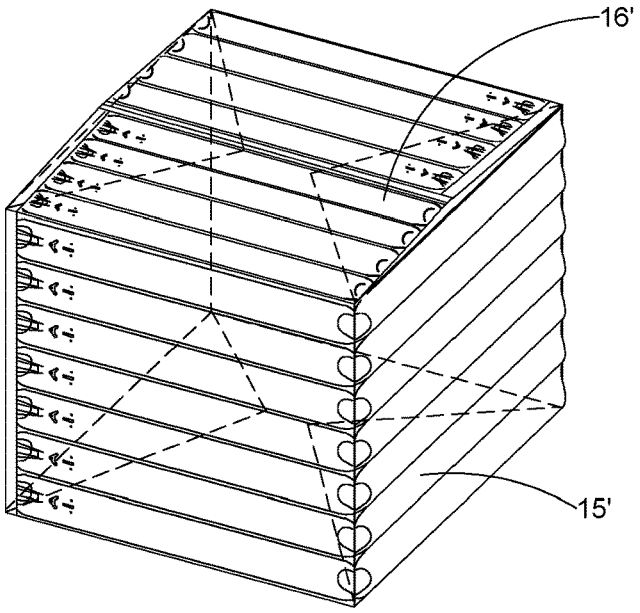
FIG. 11 is a schematic view of the rectangular air packaging device according to the above third preferred embodiment of the present invention, illustrating an opening of the rectangular air packaging device is being sealed.
Figure 12:
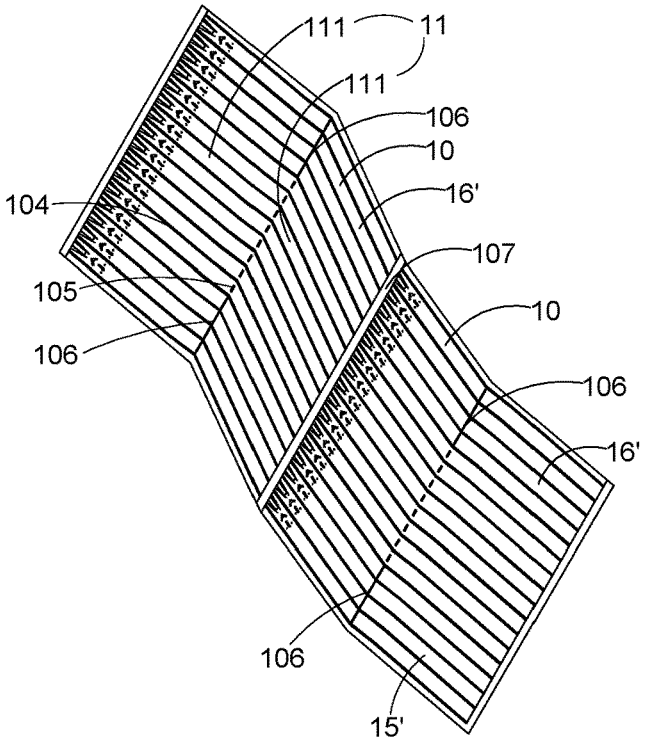
FIG. 12 is a perspective view of the rectangular air packaging device according to the above third preferred embodiment of the present invention, illustrating an unfolded structure of the rectangular air packaging device which has not been inflated yet.

Each sub-bending seam 1051 can be arranged linearly or inclinedly. In this manner, after the air packaging device is inflated, each secondary inflation unit 1111 can fit to the bottom wall or the four side walls of the air packaging device. Each secondary inflation unit 1111 can also be inserted into the containing cavity of the air packaging device between the bottom wall and the four side walls, as can be shown in FIG. 9A and FIG. 9B. The sub-bending seams 1051 are provided to reduce the inflation volume of the corresponding sub-inflation unit 111. The shape and size of the sub-bending seams 1051 is not limited. The shape of the sub-bending seams 1051 can be provided as illustrated in FIG. 9E.

It is worth mentioning that, each secondary inflation unit 1111 is used to reinforce the cushioning effect at the jointing position of the bottom wall and the four side walls of the air packaging device formed by the sub-inflation units 111.

The manufacturing method of the air packaging device according to the above preferred embodiments of the present invention comprises the following steps.

(i) Overlap a first chamber layer 101, one or more inflation valves 20 and a second chamber layer 102.

(ii) Form one or more inflation unit 11 having an inflation chamber 12 via a heat sealing technology, wherein the inflation valves 20 communicate with the inflation chamber 12, so that the inflation valves 20 can be applied to inflate gas into the inflation chamber 12, wherein after the inflation via the inflation valves 20 is finished, the pressure in the inflation chamber 12 reaches to a predetermined value, the inflation valve 20 will be sealed automatically, so as to prevent the gas in the inflation chamber 12 from being leaking through the inflation valves 20.

(iii) Inflate gas into the inflation chamber 12 through the inflation valves 20, so that each inflation unit 11 automatically bends to form a containing cavity for item to be packaged roughly along corresponding sealing positions.

It is worth mentioning that, in step (ii), the sealing technology is heat-sealing, wherein in this method, the overlapped first chamber layer 101 and second chamber layer 102 can be sealed better, wherein when the inflation chamber 12 is inflated with gas, the gas will not leak from the heat sealing position.

Furthermore, the manufacturing method further comprises the following steps: in step (ii), more than one line of parallel dividing seam 104 is formed by sealing, so as to form the side by side inflation units 11, the interval bending seams 105 are formed by sealing, in step (iii), each inflation unit 11 forms a plurality of side wall. In detail, during inflating to the inflation chamber 12, the inflatable main body 10 formed by each inflation unit 11 automatically forms the roughly rectangular containing cavity along the dividing seam 104 and the bending seam 105, so as to provide containing space for item to be packaged.

Furthermore, in step (ii), the sealing seams 106 are formed by sealing, in step (iii), the un-inflatable structures 15 and the un-inflatable portions 16 are respectively formed at the corners of the air packaging device. It is worth mentioning that, during each inflation unit 11 is inflated with gas, the inflatable main body 10 automatically forms a bottom wall, four side walls and a top wall of the air packaging device roughly along the dividing seam 104, the bending seam 105 and the sealing seam 106, wherein each un-inflatable structure 15 is formed to the joint position of the bottom wall and the four side walls, In other words, the un-inflatable structures 15 are formed in the corners of the air packaging device. During being used, the un-inflatable structure 15 can be attached to the bottom wall or the four side walls of the air packaging device, or can be inserted into the containing cavity at the joint position of the bottom wall and the four side walls; wherein the un-inflatable portions are form at the sides of the top wall, then after the item to be packaged is being put into the containing cavity, the top wall can cover the opening, so as to seal the containing cavity.

Furthermore, in step (ii), a plurality of sub-dividing seams 1041 is formed by sealing, so as to form side by side secondary inflation units 1111; interval sub-bending seams 1051 are formed by sealing, wherein in step (iii), each secondary inflation unit 1111 can be bended along each sub-bending seam 1051.

In other words, according to the rectangular air packaging bag as recited above, the inflation units 11 are selectively bended and sealed to form the side walls, wherein the side walls form the containing cavity being used to package the item to be packaged. Each two neighboring side walls are arranged with a right angle, so that the containing cavity forms a roughly rectangular shape, so as to be suitable to package rectangular item to be packaged.

In detail, according to the above preferred embodiments of the present invention, the angle between the bottom wall of the rectangular air packaging bag and the four side walls is 90°. Each two neighboring side walls are arranged with each other to define a right angle. The top wall can be folded by means of the function of the un-inflatable portions 16, so that the four side walls are roughly arranged with right angles, so as to form the rectangular bag.

It is worth mentioning that the reason for why the rectangular air packaging bag can form the rectangular structure is in the folding process, a part of the chamber layer of the side walls which is not used to form the rectangular packaging bag forms the un-inflatable structures 15 and the un-inflatable portions 16, so that the inflatable main body 10 can be bended easily, so as to form the rectangular structure. In other words, the un-inflatable structures 15 and the un-inflatable portions 16 form the adjusting portions, so that the side walls forms the roughly rectangular shape.

In addition, the un-inflatable structures 15 and the un-inflatable portions 16 can be implemented and replaced with inflatable structure, but the inflation volume of the inflatable structure is less than the inflation volume of other portions of the rectangular packaging bag, so that the inflatable structure is suitable to be bended, or the shape of the inflatable structure can be changed, so that it is possible to form the rectangular structure, more detail will be further described in the following embodiments.

Referring to FIGS. 10 to 13, a rectangular air packaging device according to a third preferred embodiment of the present invention is illustrated. According to this preferred embodiment of the present invention, the shape of the air packaging device can be square. According to the above embodiments, the shape of the rectangular air packaging device is oblong. In other words, According to this preferred embodiment of the present invention, the area of each side wall can be roughly equivalence, and the interior angle between each two neighboring sides is approximately 90°, so as to form a regular square shape.

According to this preferred embodiment of the present invention, the rectangular air packaging device comprises two inflatable main bodies 10. One end of one inflatable main body 10 is connected together with one end of the other one of the two inflatable main bodies 10 via an end sealing seam 107. Each inflatable main body 10 comprises a plurality of inflation unit 11. Each inflation unit 11 is bended to form the sub-inflation units 111, so that the sub-inflation units 111 form the side walls. The sub-inflation units 111 of the two inflatable main bodies 10 define a roughly square containing cavity 100. The containing cavity 100 has an opening 110 being used to pick out and place in the item to be packaged.

According to this preferred embodiment of the present invention, two adjusting portions 15' are respectively provided at the two interior corners of the rectangular air packaging device. Sealing seams 106 are provided at the adjusting portions 15', so that the adjusting portions 15' cannot be inflated. After being folded and heat-sealed, each side wall of the rectangular air packaging device is provided with eight sub-inflation units 111. In addition, two adjusting portions 16' are provided at two opposite sides of the opening 110. Via pressing the adjusting portions 16', four sub-inflation units 111 at the other two opposite sides of the opening 110 are pivotally moved, so as to seal the opening 110.

Figure 13:
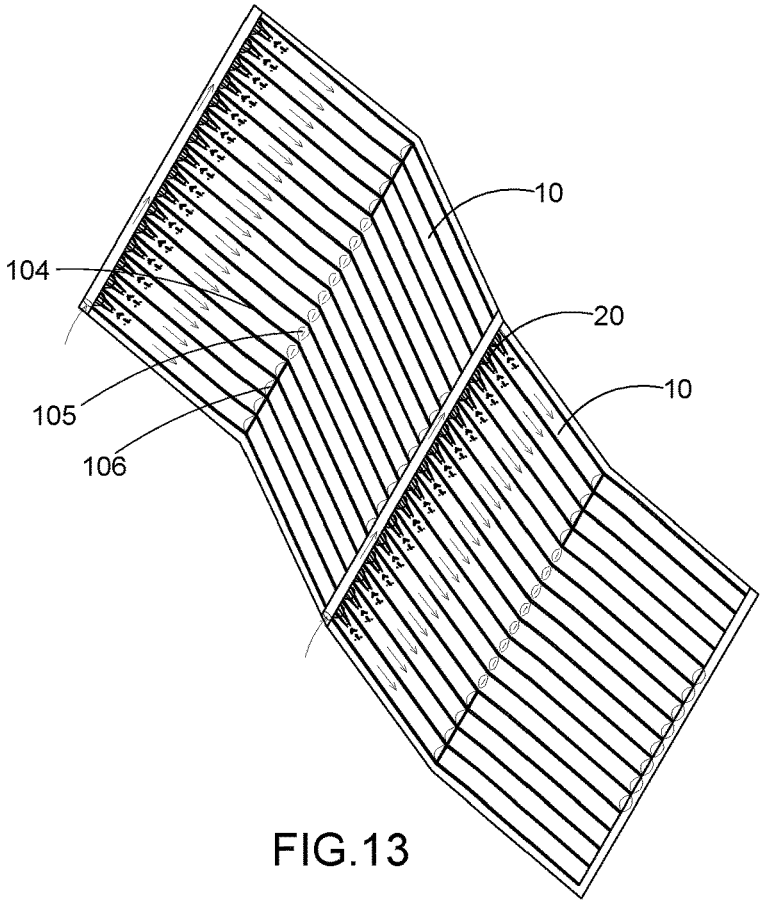
FIG. 13 is a perspective view of the rectangular air packaging device according to the above third preferred embodiment of the present invention illustrating it being inflated.

Referring to FIG. 13, the sealing seams 106 can be respectively provided along a same line with the bending seams 105, and be provided vertically with respect to the direction of the inflation unit 11. It is worth mentioning that the shape, size and position of the sealing seams 106 are not limited, which can be provided according to different requirements, as long as the adjusting portion 15' cannot be inflated.

After the rectangular air packaging device is folded and heat-sealed, the corners of the adjusting portions 15' are suitable to be inserted into the containing cavity 100. Or, the adjusting portions 15' can be protruded and extended at the outer side of the rectangular air packaging device. The air cushioning effect of the whole rectangular air packaging device will not be affected.

It is worth mentioning that according to this preferred embodiment of the present invention, the inflation unit 11 of the rectangular air packaging device extending horizontally. And the inflation units 11 according to the above preferred embodiment extend longitudinally, as can be shown in the drawings. The sub-inflation units 111 being longitudinally with the adjusting portions 15' of the two inflatable main bodies 10 form the bottom wall of the air packaging device.

Figure 14:
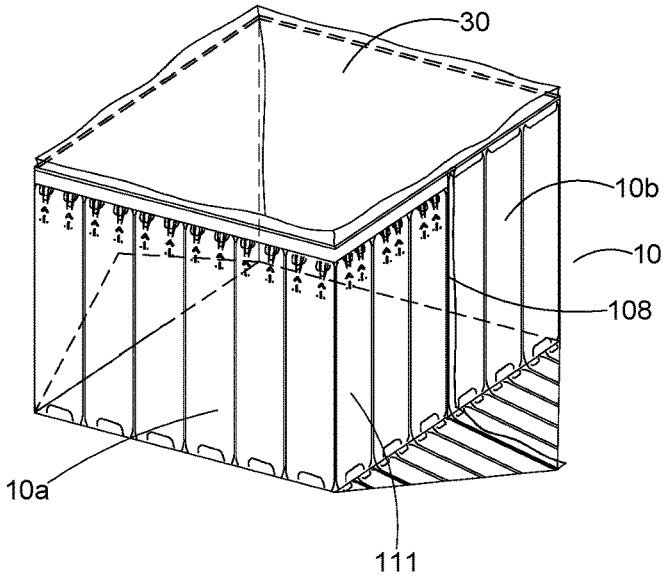
FIG. 14 a perspective view of a rectangular air packaging device according to a fourth preferred embodiment of the present invention.
Figure 15:
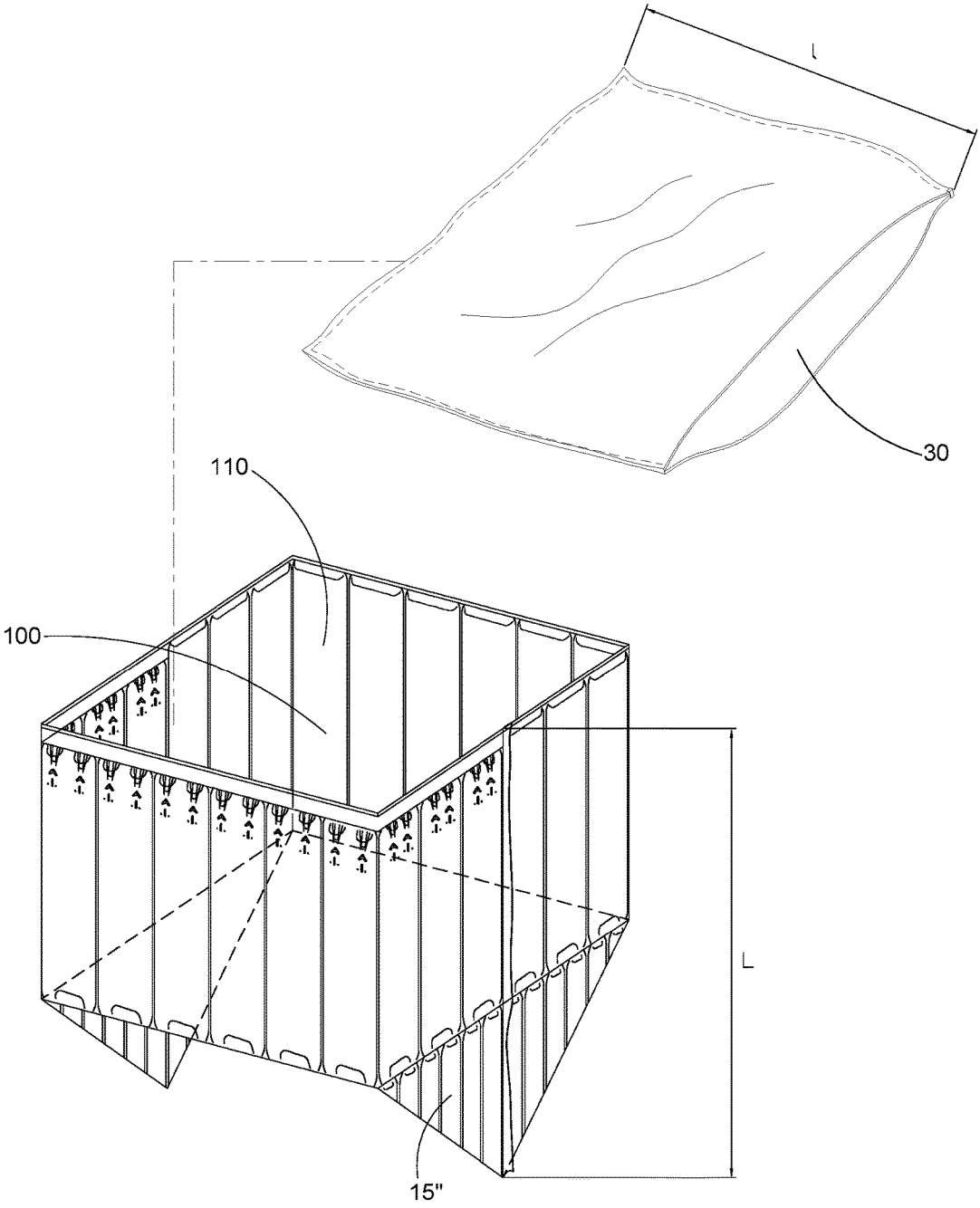
FIG. 15 is an explosive perspective view of the rectangular air packaging device according to the above fourth preferred embodiment of the present invention.
Figure 16:
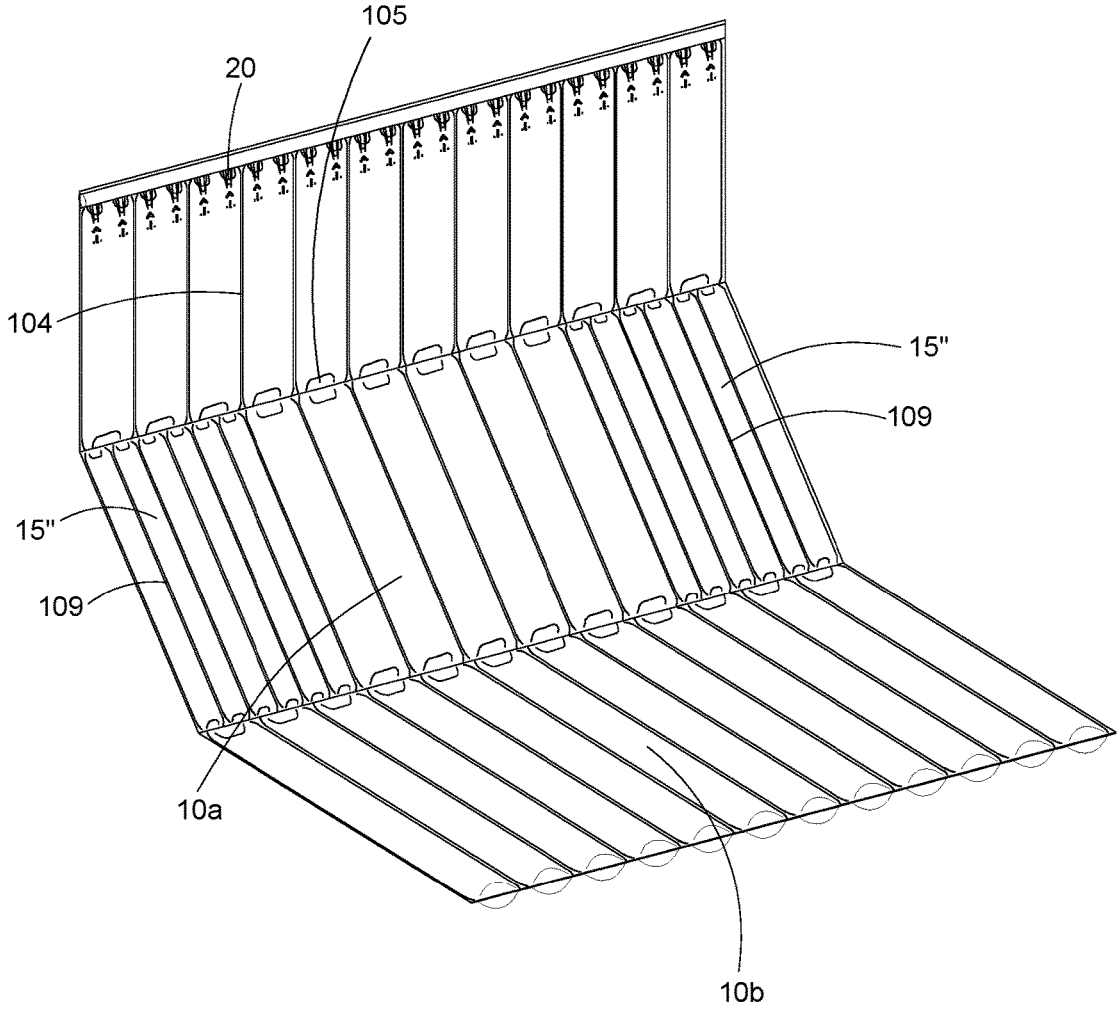
FIG. 16 is an explosive perspective view of the rectangular air packaging device according to the above fourth preferred embodiment of the present invention, illustrating an unfolded structure of the rectangular air packaging device.

Referring to FIGS. 14 to 16, a rectangular air packaging device according to a fourth preferred embodiment of the present invention is illustrated. The shape of the rectangular air packaging device also can be square. The rectangular air packaging device has a bottom side wall 10*a*, four surround side walls 10*b*. Each one of the bottom side wall 10*a* and the four surround side walls 10*b* has six sub-inflation units 111, so that the areas of each side wall can be equal so as to form a square shape.

It is worth mentioning that, the rectangular air packaging device is formed by heat-sealing and bending the packaging materials illustrated in FIG. 16, as can be shown in FIG. 14. The six sub-inflation units 111 can be formed by bending the bottom side wall 10*a*, the front side wall and the rear side wall. The left surround side wall 10*b* is formed by heat-sealing two sets of three sub-inflation units 111 together along side edges thereof. The right surround side wall 10*b* is formed by heat-sealing two sets of three other sub-inflation units 111 together along side edges thereof. In detail, the side sealing seams 108 seal the side edge of the three sub-inflation units 111 with the side edge of the other three sub-inflation units 111, so as to provide the six sub-inflation units 111 at the left side and the right side.

According to this preferred embodiment of the present invention, the rectangular air packaging device further provides a functional layer 30. The functional layer 30 can be an outer packaging layer or an inner packaging layer, so as to provide extra functions for the rectangular air packaging device. For example, the functional layer 30 can be a layer of cushioning film, so as to provide cushioning effect. The functional layer 30 can be made of other materials, such as thermal insulating materials and light screening materials, so as to provide other functions. The functional layer 30 can also be paper material, so as to form a packaging box. The functional layer 30 can also be other cushioning materials, such as foam materials. In detail, according to a special embodiment, the stereoscopic air packaging device can be attached into the functional layer 30, so that when the rectangular air packaging device being inflated, the functional layer 30 can be stretched and unfolded. In other words, the functional layer 30 can be a paper packaging box. The rectangular air packaging device is provided into the paper packaging box. Before the rectangular air packaging device is inflated, the paper packaging box is in a folded state. While the rectangular air packaging device being inflated, each air chamber can be inflated, so that the paper packaging box being in the folded state can be stretched to form a box body which can be used to contain item to be packaged.

If the functional layer 30 forms an inner bag and a layer of cushioning film, the functional layer 30 can be provided into the rectangular air packaging device in a hanging state. After the rectangular air packaging device is inflated, the functional layer 30 can contact with the bottom side wall of the rectangular air packaging device and also may not contact with the bottom side wall of the rectangular air packaging device.

Referring to FIG. 16, according to this preferred embodiment of the present invention, each adjusting portion 15" is not an un-inflatable portion, but an inflatable structure, but the sub-inflation unit 111 is provided with air rejecting seams 109, which can be arranged along the lengthen direction of the corresponding sub-inflation units 111, so as to further divide the sub-inflation units 111 into gas chamber main body with a smaller diameter, so that the inflation volume is reduced, so that the folding and seal can be more easy, so as to form an inner right angle structure.

Figure 17:
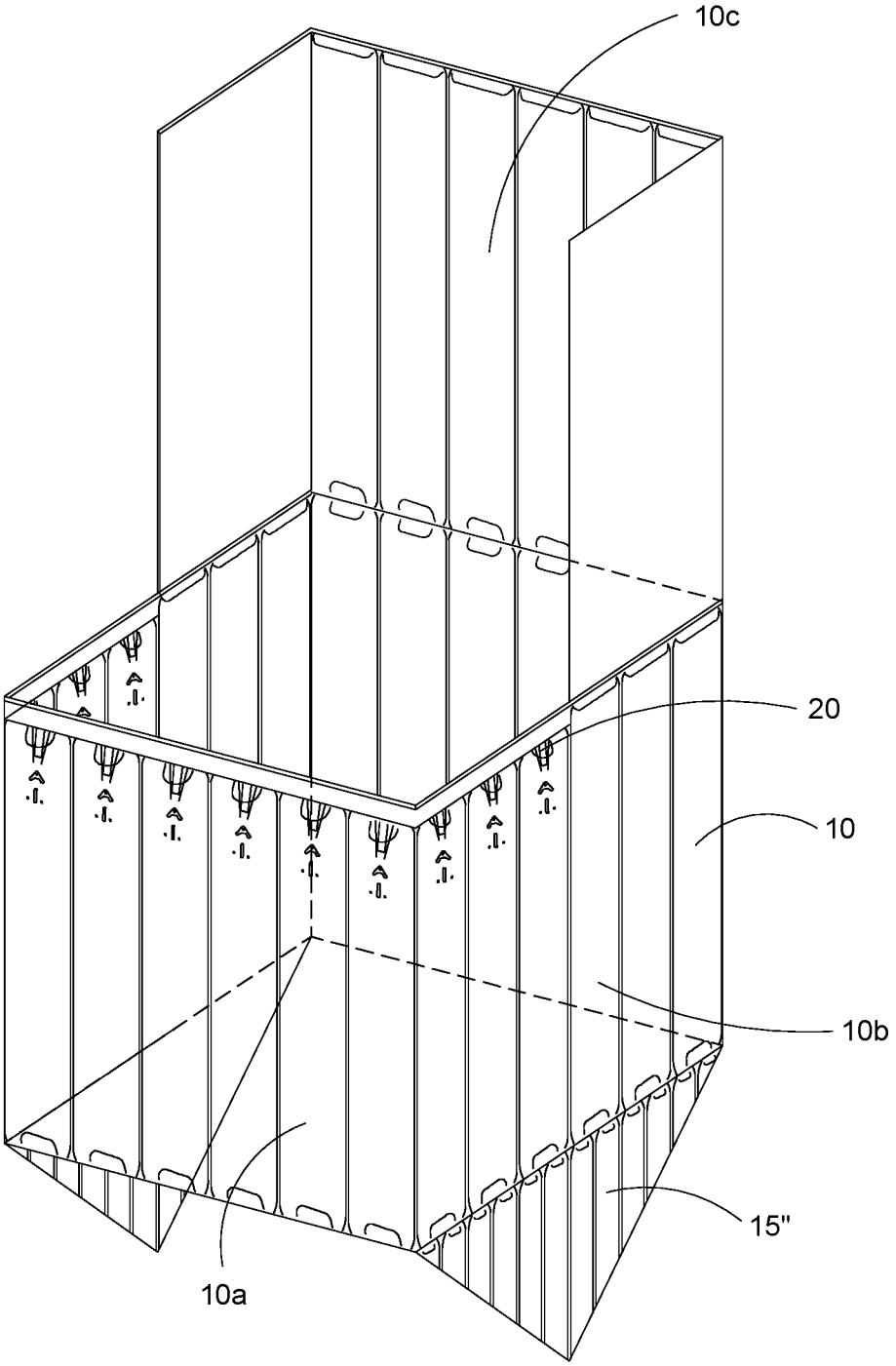
FIG. 17 illustrates an alternative mode of the rectangular air packaging device according to the above fourth preferred embodiment of the present invention.
Figure 18:
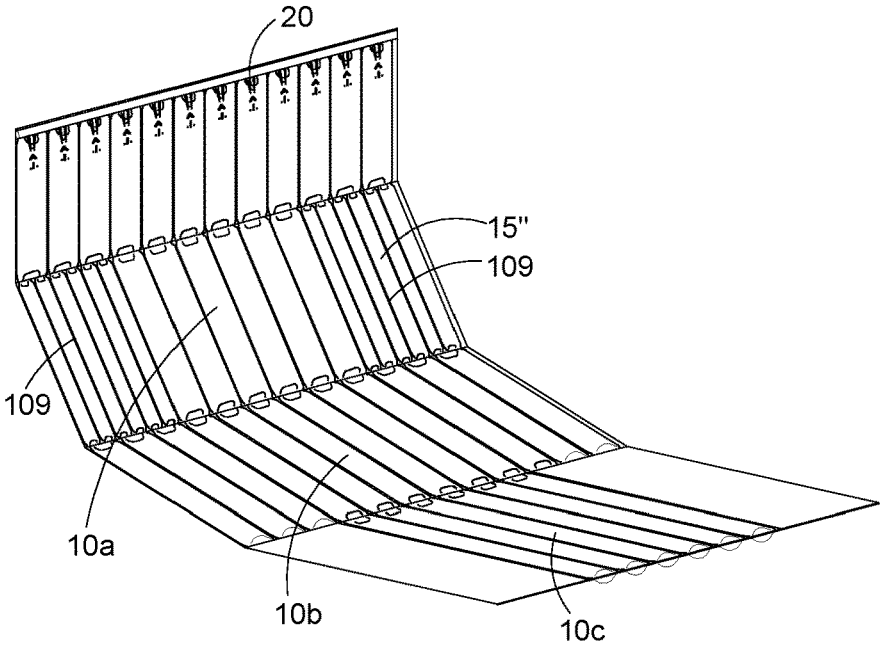
FIG. 18 is a schematic view of a rectangular air packaging device according to an alternative mode of the above fourth preferred embodiment of the present invention, illustrating an unfolded structure of the rectangular air packaging device.

Referring to FIGS. 17 to 18, a rectangular air packaging device according to an alternative mode of the fourth preferred embodiment of the present invention. The rectangular air packaging device further forms a top side wall 10*c*, which is suitable to close the opening 110 of the containing cavity 100. One skilled in the art will understand that the top side wall 10*c* can also provide six sub-inflation units 111. One skilled in the art will understand that other structures can also be used to close the opening 110.

Figure 19:
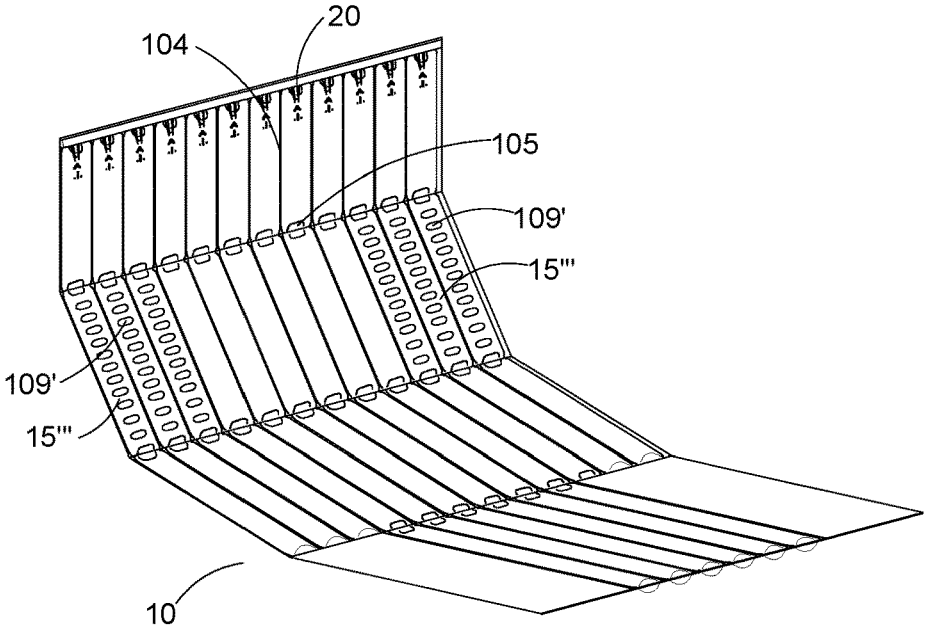
FIG. 19 is a schematic view of a rectangular air packaging device according to another alternative mode of the above fourth preferred embodiment of the present invention, illustrating an unfolded structure of the rectangular air packaging device.

According to the alternative mode illustrated in FIG. 19, each adjusting portion 15' is suitable to be folded, and is not a un-inflatable portion, but is an inflatable structure. But each sub-inflation unit 111 is provided with a plurality of air rejecting seams 109', which can be arranged along the vertical direction of the corresponding sub-inflation units 111, so as to form a plurality of secondary inflation units 1111 communicating with each other, so that the inflation volume is reduced, so that the folding and seal can be more easy, so as to form an inner right angle structure.

It is worth mentioning that, the sub-dividing seam 1041 and the sub-bending seam 1051 according to the above second preferred embodiment of the present invention similar to air rejecting seams, so that the inflation volume is reduced, so that the air packaging device can be folded and sealed easily, so as to form an inner right angle structure.

In addition, one skilled in the art will understand that while forming the square packaging bag, the number of the sub-inflation units 111 at the side wall of the rectangular air packaging device can be selected as being required, for example, each rectangular air packaging device has 3~100 sub-inflation units 111. But the number of the sub-inflation units 111 in each side wall is same. If the numbers of the sub-inflation units 111 are not equal, or the length is not equal, a rectangular packaging bag can be formed.

Figure 20:
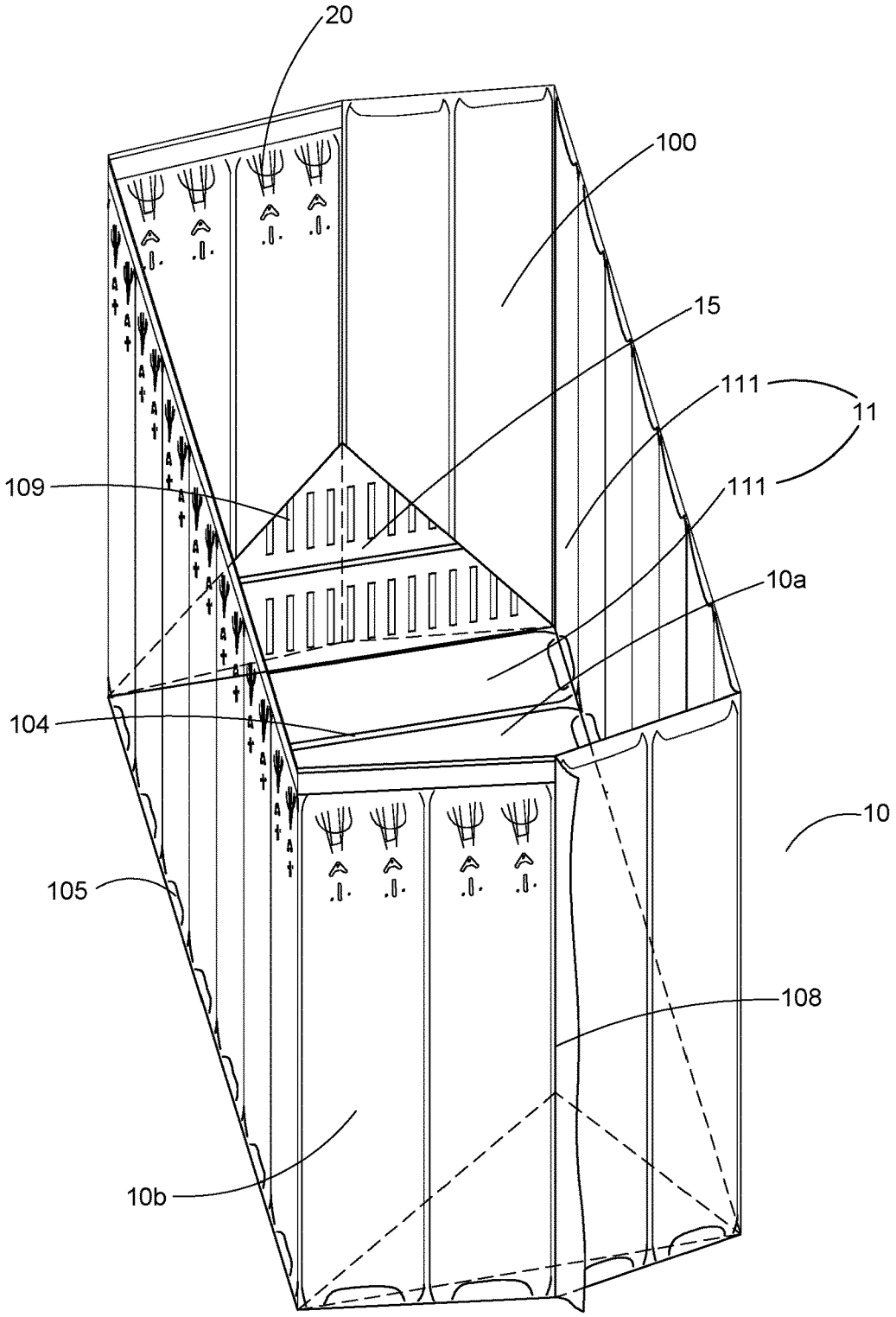
FIG. 20 is a perspective view of a rectangular air packaging device according to a fifth preferred embodiment of the present invention.
Figure 21:
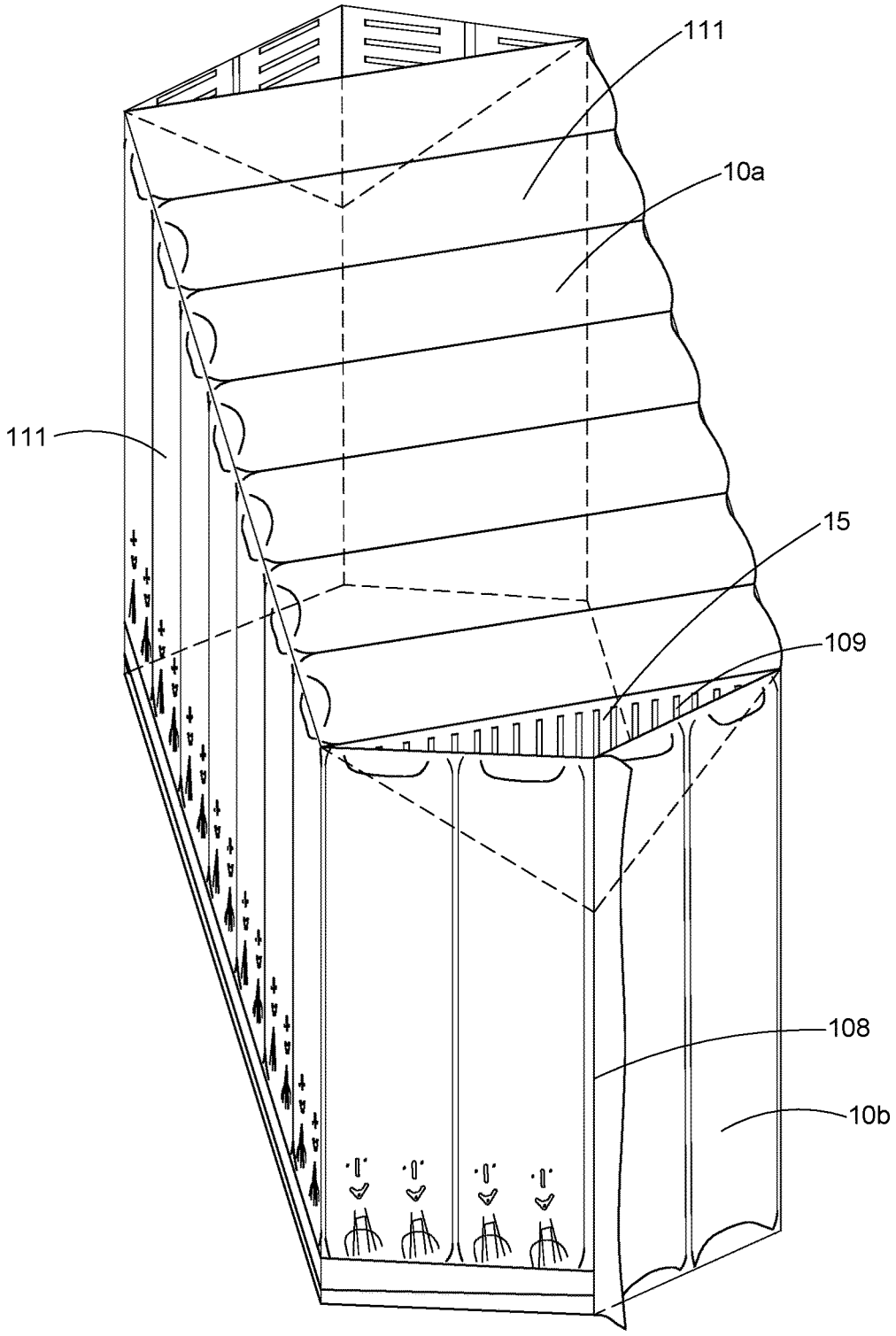
FIG. 21 illustrates a bottom structure of the rectangular air packaging device according to the above fifth preferred embodiment of the present invention.
Figure 22:
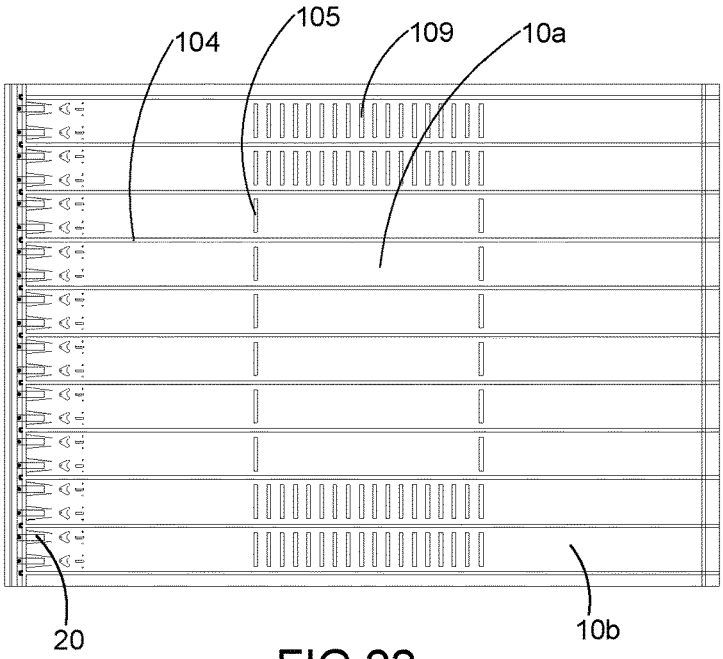
FIG. 22 is a schematic view of a rectangular air packaging device according to the above fifth preferred embodiment of the present invention, illustrating an unfolded structure of the rectangular air packaging device.

Referring to FIGS. 20 to 22, a rectangular air packaging device according to a fifth preferred embodiment of the present invention is illustrated. The rectangular air packaging device comprises an inflatable main body 10 and has two adjusting portions 15A. The inflatable main body 10 is provided with at least one inflation valve 20 being suitable to connect with the adjusting portion 15A, so as to form an air cushioning packaging bag. The inflation valves 20 are used to inflate into the inflatable main body 10, so that the inflatable main body 10 is suitable to provide air cushioning effect to the item to be packaged.

In detail, according to this preferred embodiment of the present invention, the inflatable main body 10 of the stereoscopic air packaging device also comprises a plurality of inflation unit 11 being similar with the inflatable main body 10 according to the first preferred embodiment of the present invention. Dividing seams 104 are provided between neighboring gas chambers. The inflatable main body 10 can be bended along the bending seams 105 to form different side walls.

In addition, two sides of the stereoscopic air packaging device are connected together via side sealing seams 108. The side sealing seams 108 can be continuous or interrupted. In more detail, the stereoscopic air packaging device according to this preferred embodiment of the present invention forms an air cushioning packaging bag having a bottom wall 10*a*, four side walls 10*b* extending from the bottom wall 10*a* and having an opening at the other side of the four side walls 10*b* with respect for the bottom wall 10*a*.

The two adjusting portions 15A are respectively provided at two corners of the stereoscopic air packaging device, so that the corners of the air cushioning packaging bag can be folded easily, so as to form a spatial configuration. The bottom wall 10*a* can be provided to be vertical with the four side walls 10*b*, so as to form regular rectangular or square containing space 100 between the bottom wall 10*a* and the four side walls 10*b*.

A plurality of air rejecting seam 109 is provided at the sub-inflation units 411 of the adjusting portions 15A. This air rejecting seams 109 reduce the inflation volume of the corresponding sub-inflation units 111, so that the adjusting portion 15A can be folded easily. The air rejecting seams 109 can be formed by heat-sealing. The shape, size and position of the air rejecting seams 109 are not limited. For example, the air rejecting seams 109 can be a plurality of heat sealing line or heat sealing block transversely, longitudinally or inclinedly arranged.

In addition, each adjusting portion 15A extends between corresponding side walls 10*b* and the bottom wall 10*a*, so as to be able to be inserted into the containing space 100. The adjusting portions 15A can be extended to the outer of the inflatable main body 10. The air cushioning effect of the air cushioning bag formed by the stereoscopic air packaging device forms will not be damaged.

It is worth mentioning that, according to this preferred embodiment of the present invention, for example, the left side walls 10*b* has four sub-inflation units 111 being formed by heat-sealing and folding four inflation units 11. In more detail, the middle portion of the four inflation units 11 form the adjusting portion 15A, due to the air rejecting seams 109 are provided. The two sides of the middle portions of the sub-inflation units 111 are not provided with the air rejecting seams 109 forming the left side wall 10*b*. The sides of the left side wall 10*b* are sealed via the side sealing seam 108. The side sealing seam 108 seals the side of the left side wall together with the side of the adjusting portion 15A. The side sealing seam 108 can be a continuous or intermittent heat-sealing line.

Figure 23:
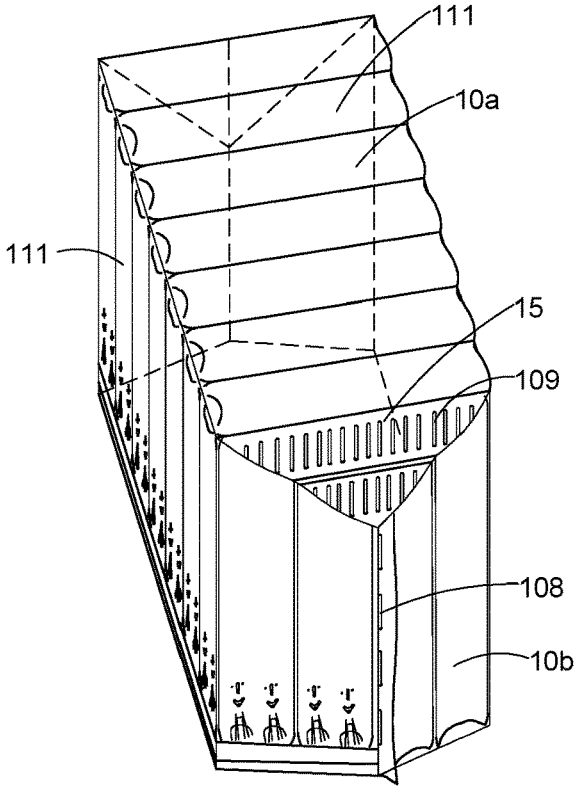
FIG. 23 illustrates a bottom structure of the rectangular air packaging device according to the above fifth preferred embodiment of the present invention.

FIG. 23 illustrates different things with FIG. 22. As illustrated in FIG. 22, the adjusting portion 15A is sealed inside the left side wall or the right side wall. According to this preferred embodiment of the present invention, the adjusting portion 15B can be sealed out of the left side wall or the right side wall. As secondary sealed seams, the side sealing seam 108 can be an intermittent heat-sealing line comprising a plurality of heat-sealing point interval with each other.

Figure 24:
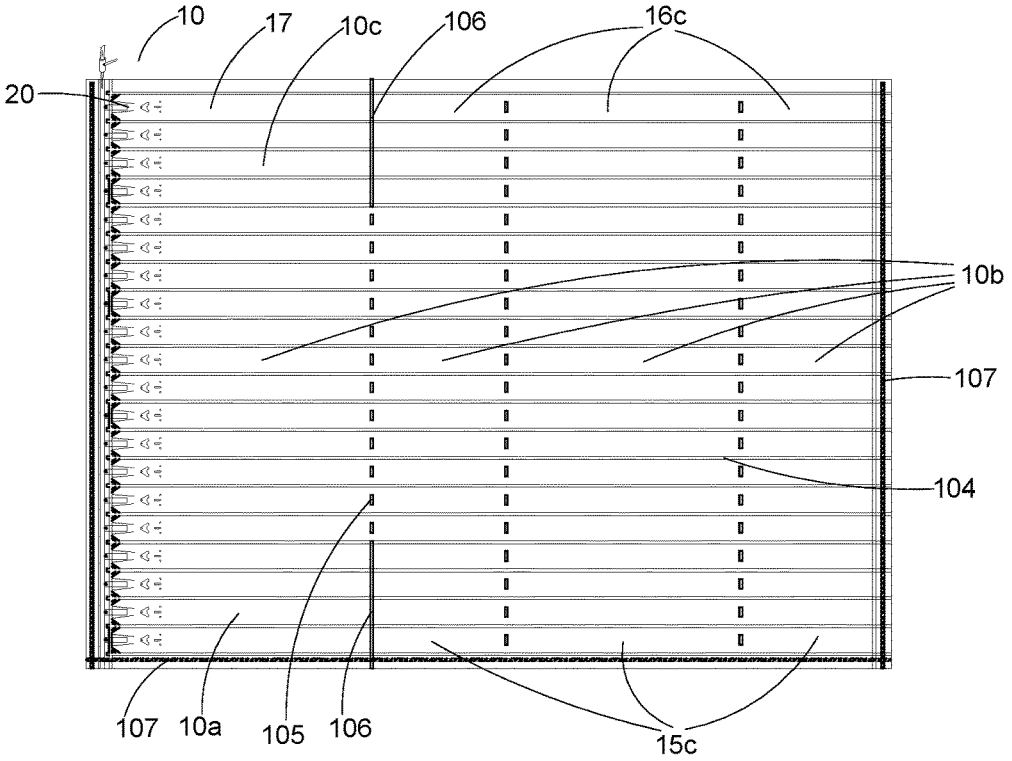
FIG. 24 is a perspective view of a rectangular air packaging device according to a sixth preferred embodiment of the present invention, illustrating an unfolded structure of the rectangular air packaging device.
Figure 25:
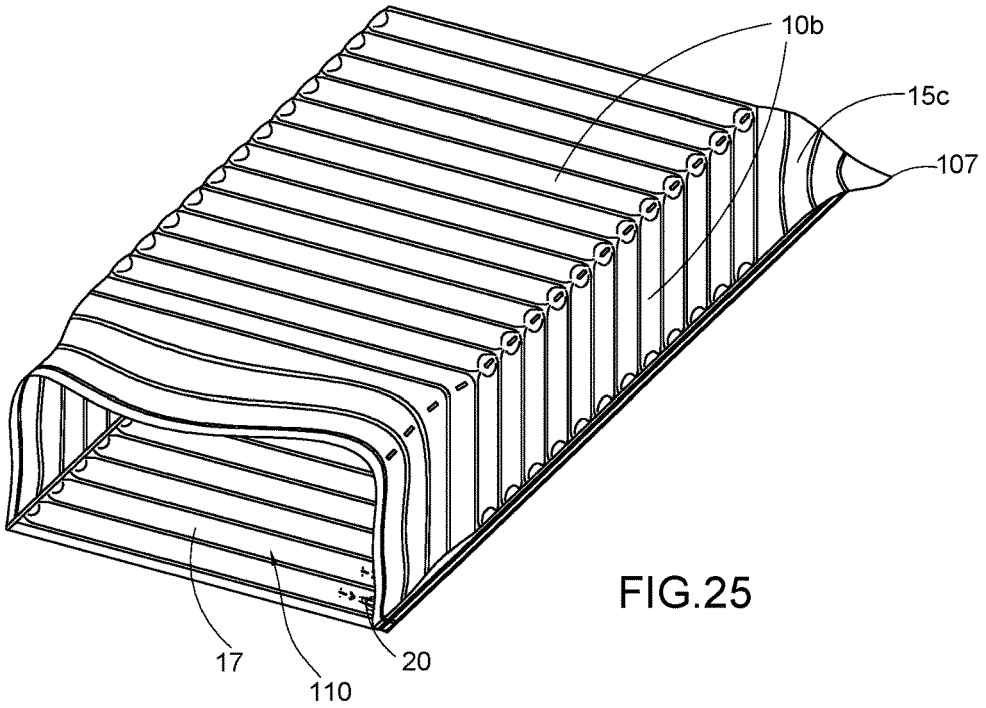
FIG. 25 is a perspective view of the rectangular air packaging device according to the above sixth preferred embodiment of the present invention, illustrating an inflated structure of the rectangular air packaging device.
Figure 26:
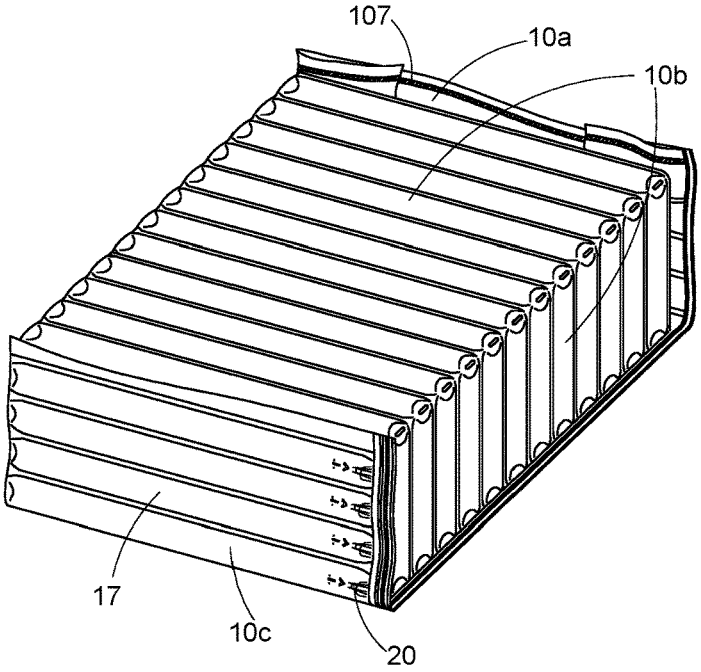
FIG. 26 is a perspective view of the rectangular air packaging device according to the above sixth preferred embodiment of the present invention, illustrating the top side and the bottom side of the rectangular air packaging device being folded.
Figure 27:
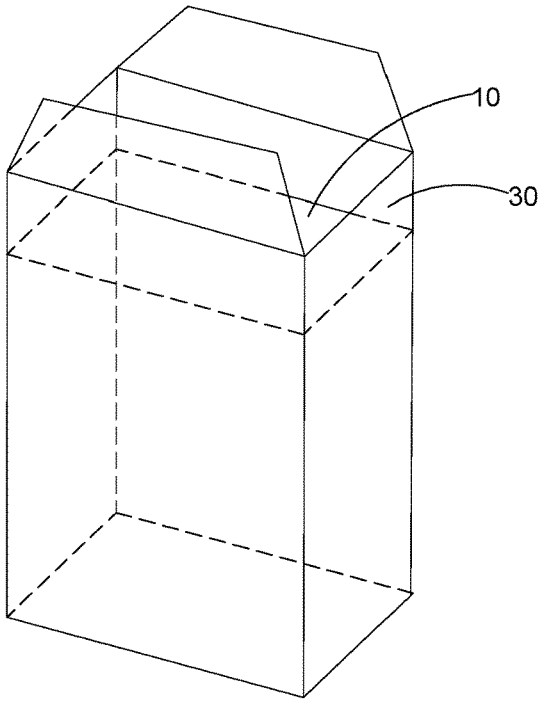
FIGS. 27 to 42 illustrate packaging boxes which can be used together with the rectangular air packaging device according to the present invention.
Figure 28:
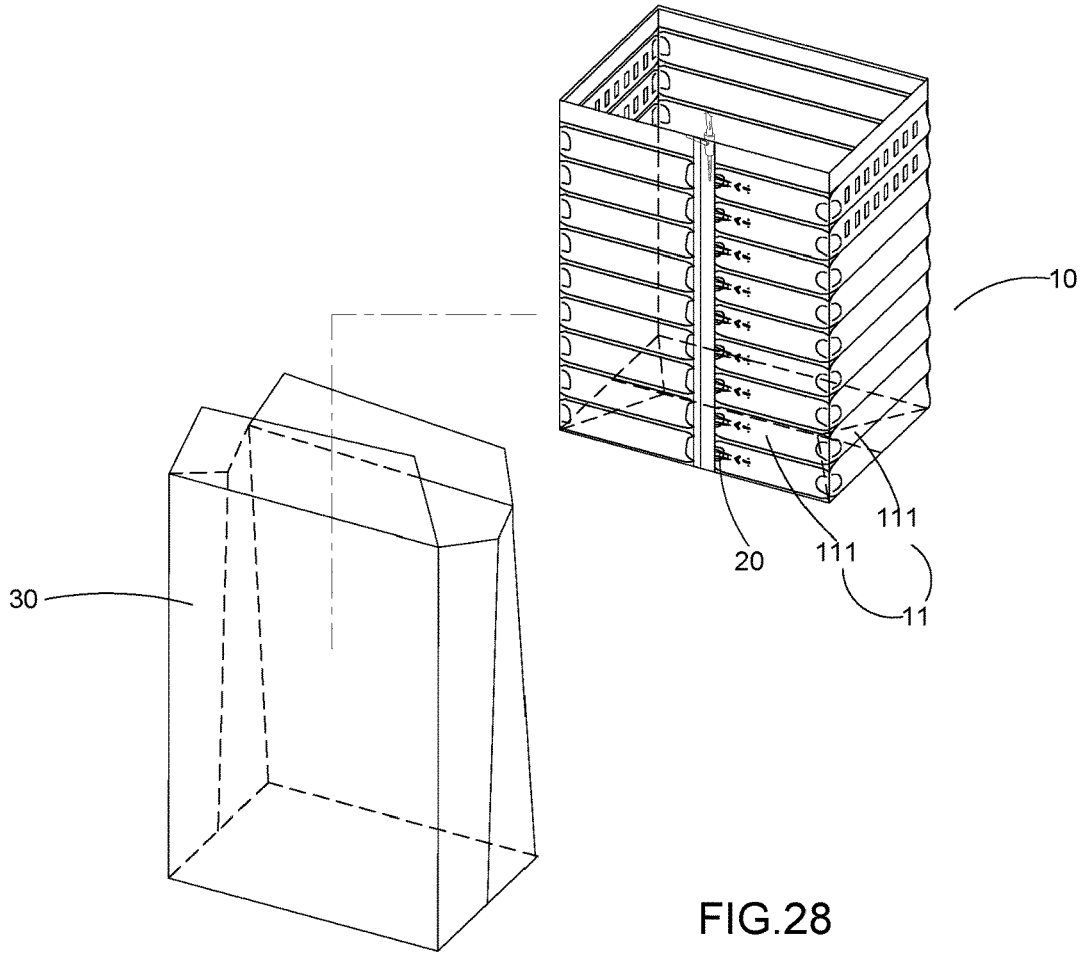
Figure 29:
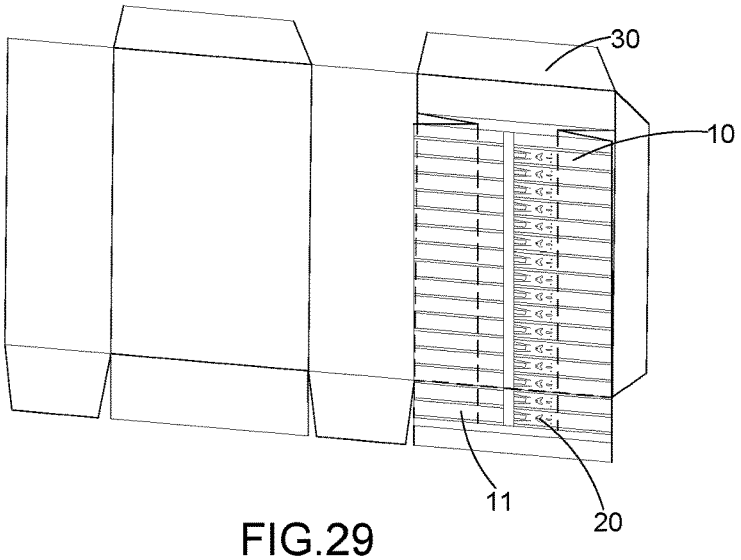
Figure 30:
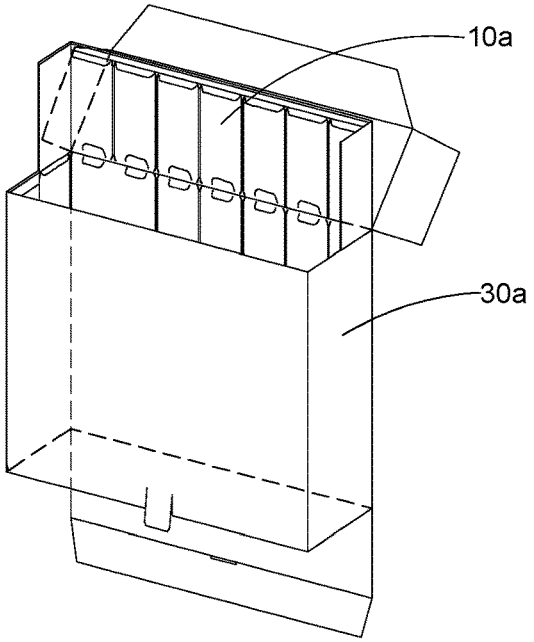
Figure 31:
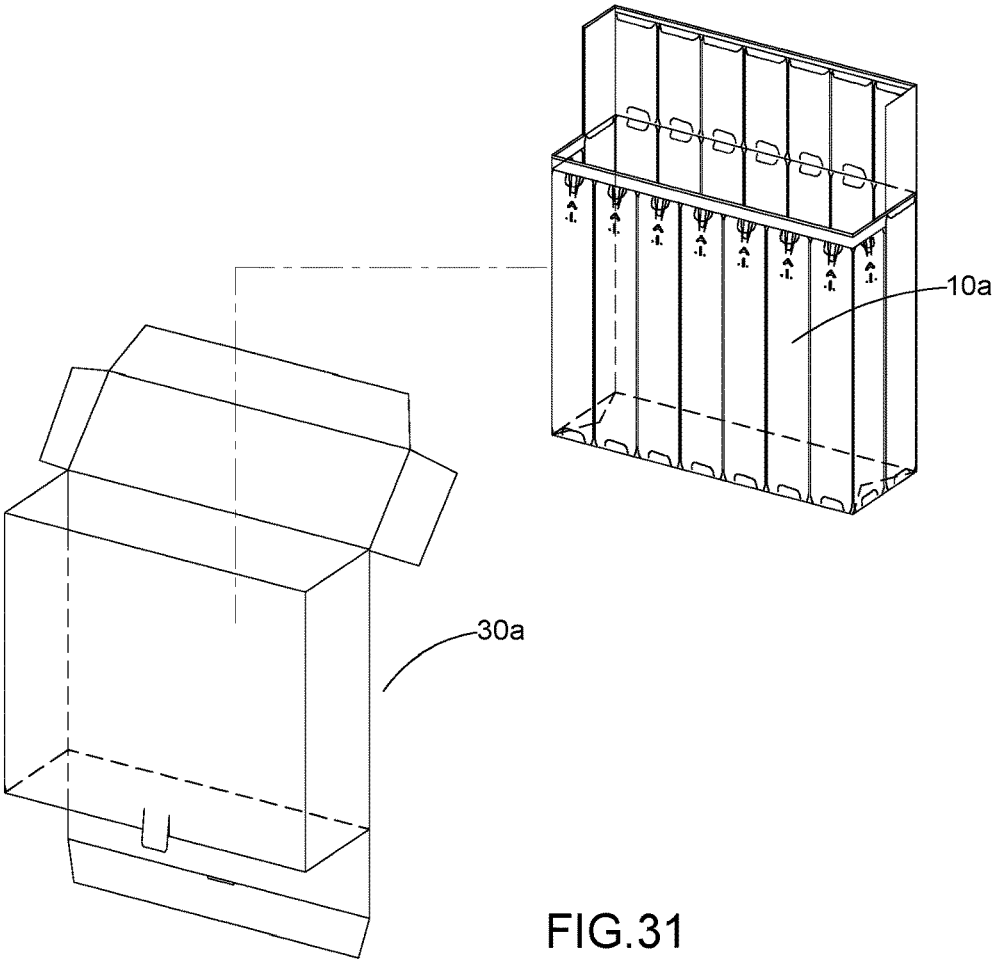
Figure 32:
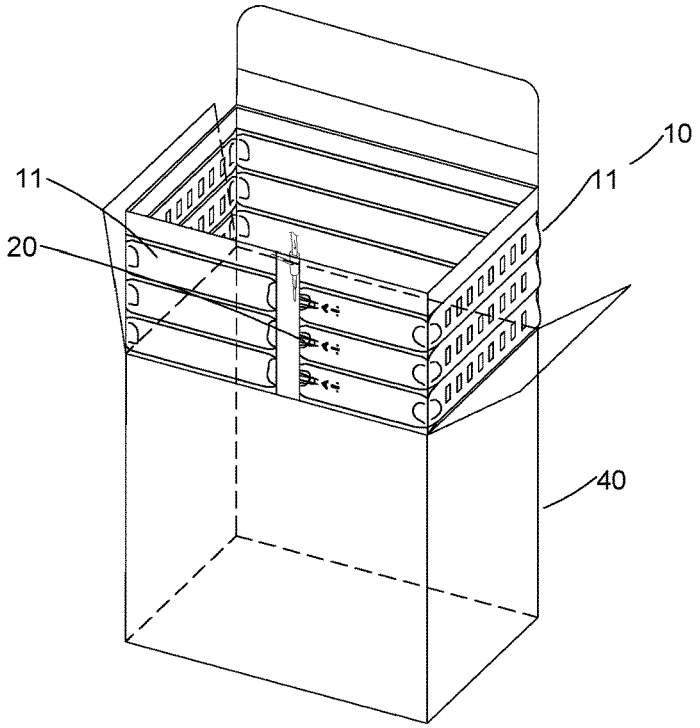
Figure 33:
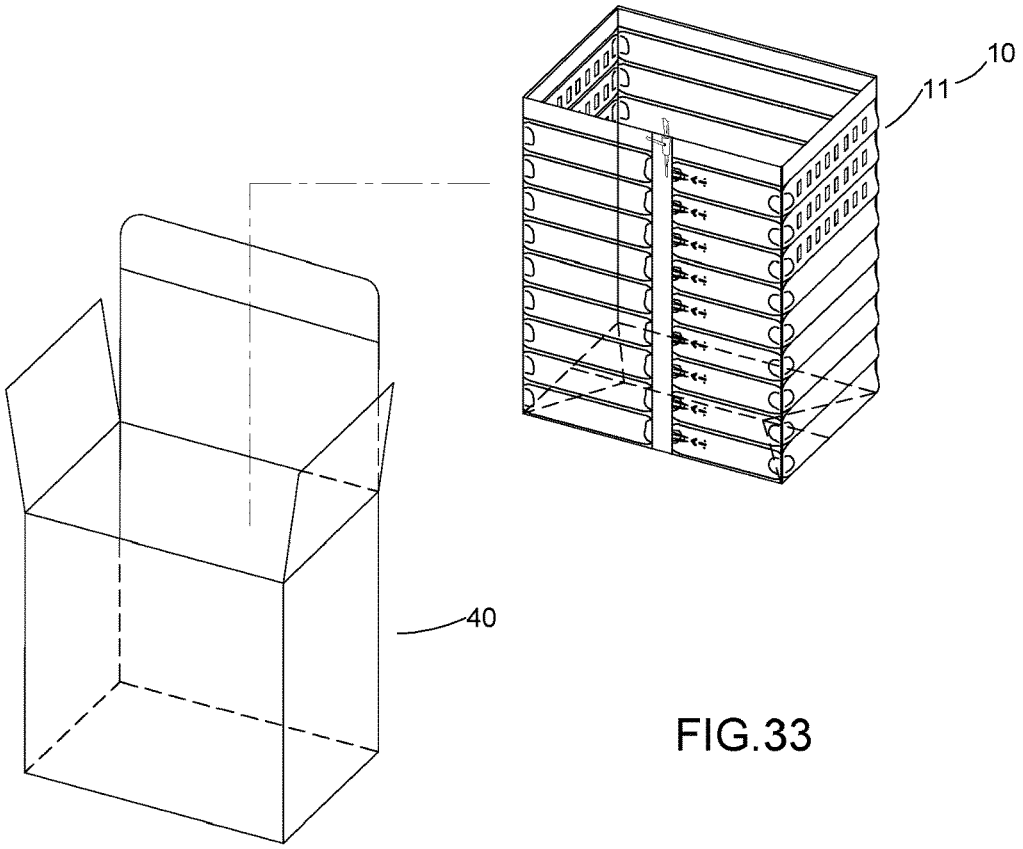
Figure 34:
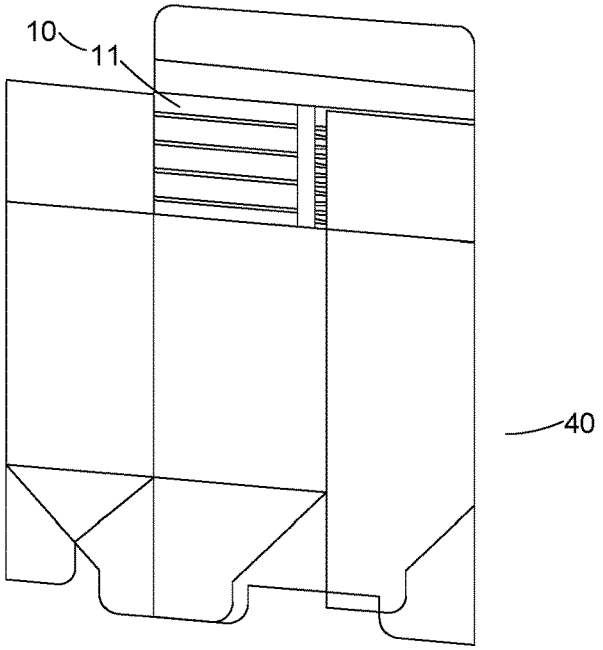
Figure 35:
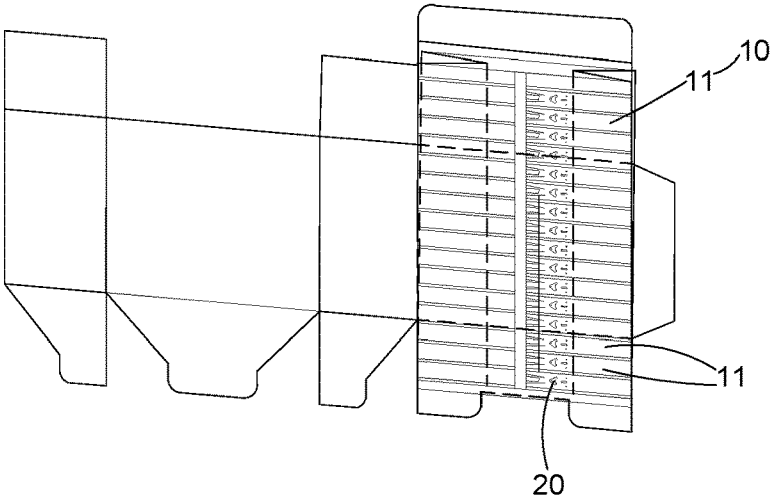
Figure 36:
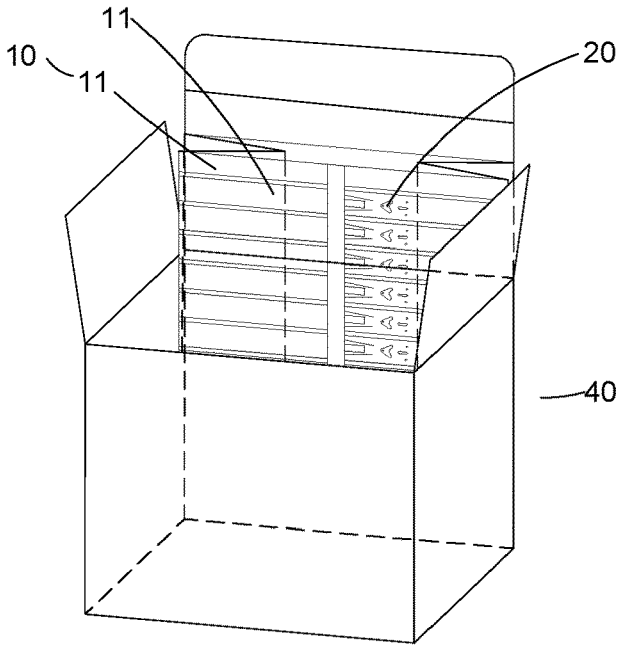
Figure 37:
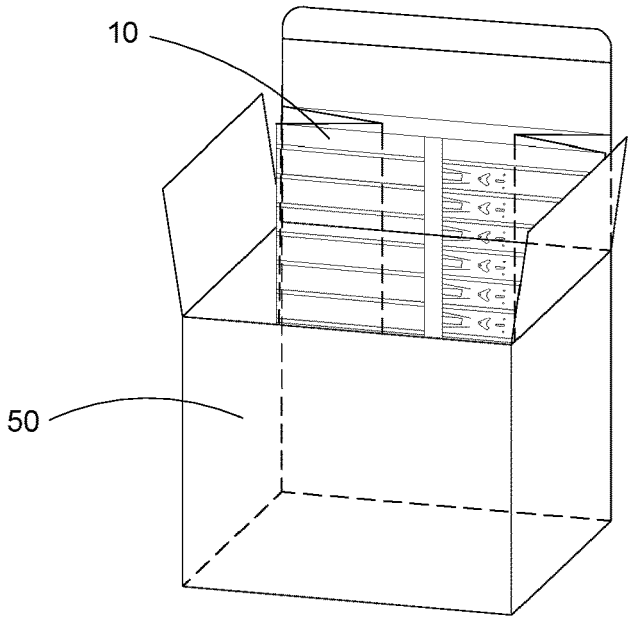
Figure 38:
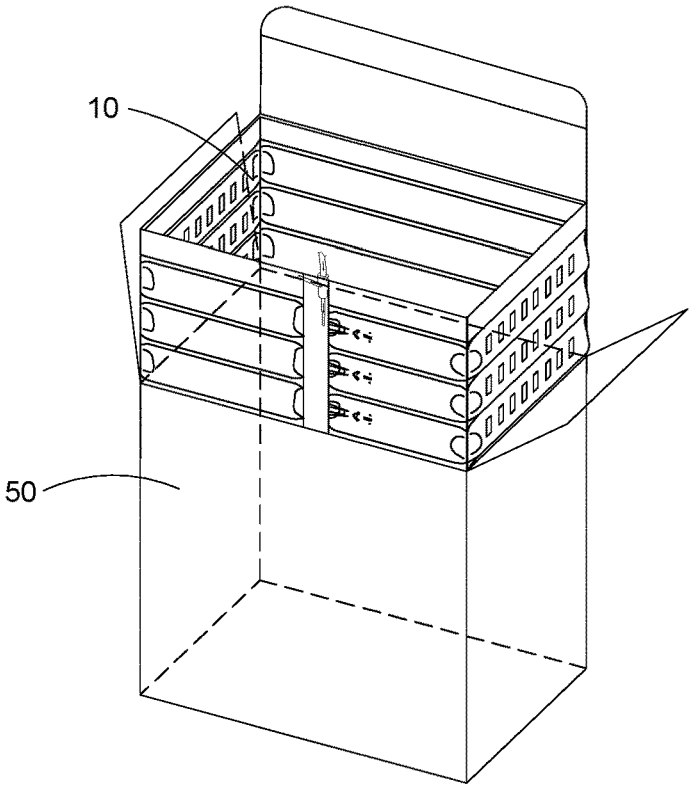
Figure 39:
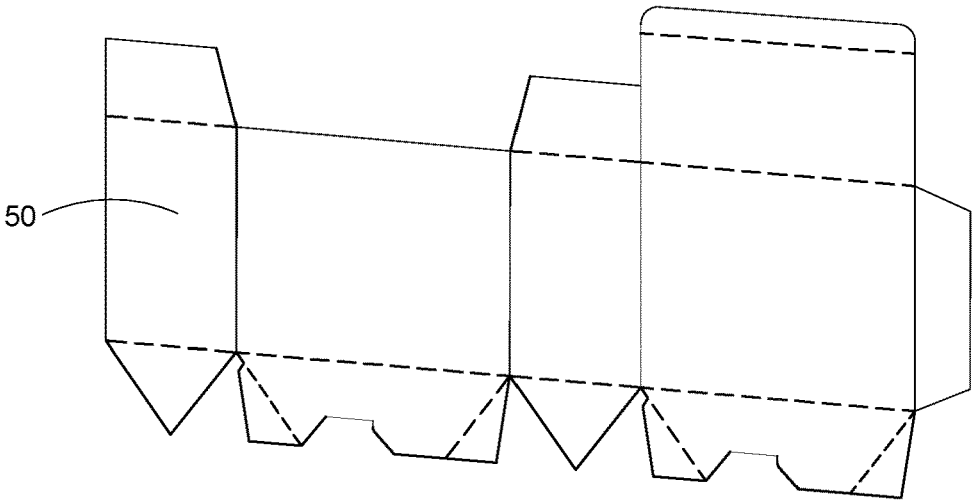
Figure 40:
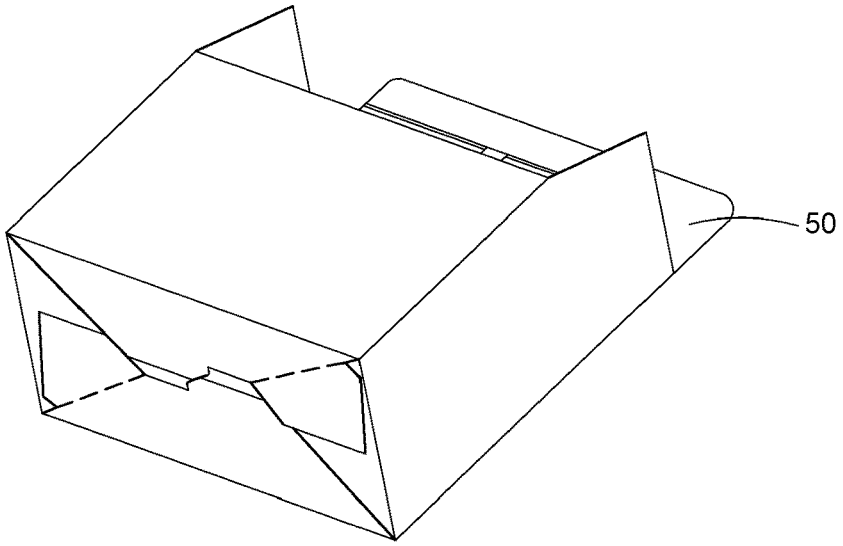
Figure 41:
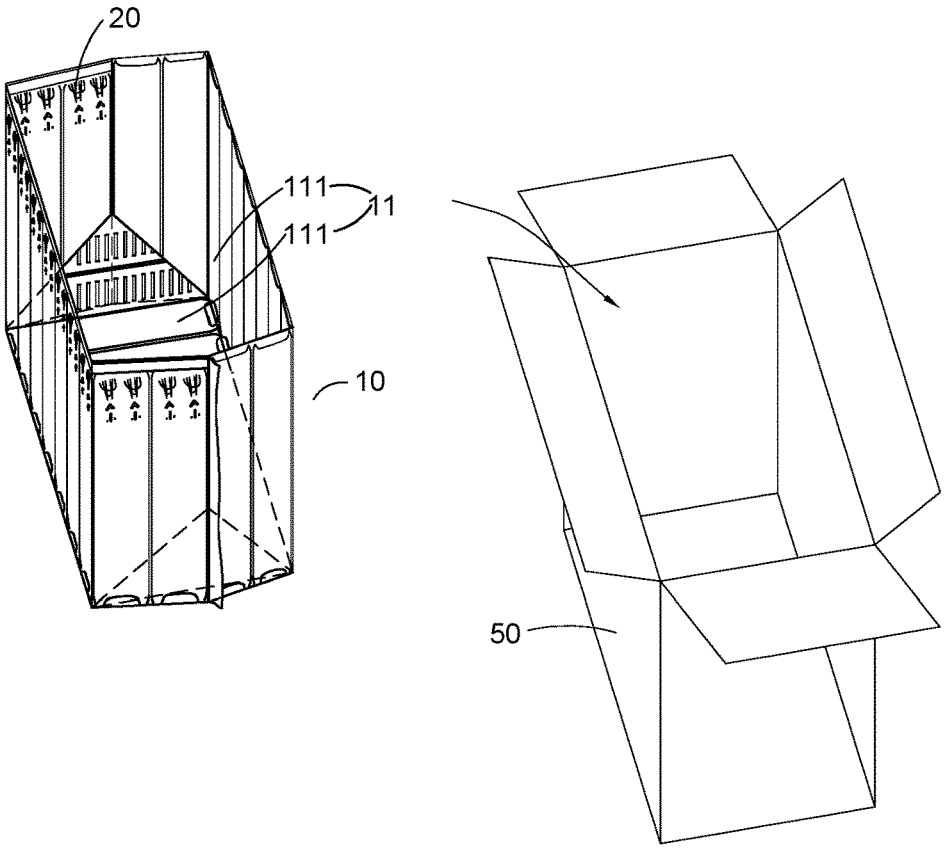
Figure 42:
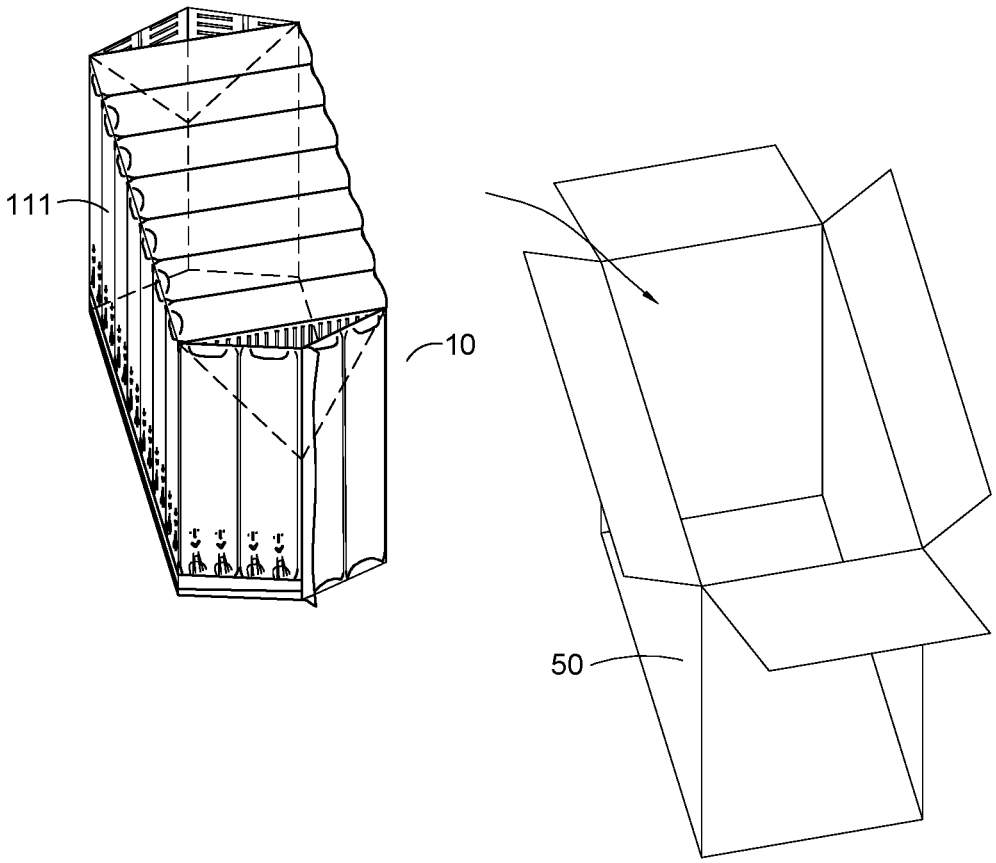

Referring to FIGS. 24 to 26, an air packaging device according to a sixth preferred embodiment of the present invention is illustrated. Similarly the air packaging device comprises an inflatable main body 10 and a plurality of inflation valve 20 being used to inflate into each inflation unit 11 of the inflatable main body 10. According to this preferred embodiment of the present invention, as can be shown in FIG. 24, the inflation valve 20 is provided at the left side of the inflatable main body 10. Two sealing seams 106 are respectively provided at two sides of the left line of the bending seam 105, so as to form inflatable sub-inflation units 111 between the inflation valve 20 and the sealing seam 106. The other side of the sealing seam 106 is providing with an un-inflatable adjusting portion 15*c* and 16*c*.

As can be shown in the drawings, similarly, inflatable main body 10 according to the present invention forms a bottom wall 10*a*, four side walls 10*b* and a top wall 10*c*. Referring to FIG. 24, the sub-inflation units 111 at the left bottom form the inflatable structure of the bottom wall 10*a*. Other three side walls are all un-inflatable structures, and are sealed along the bottom end sealing seam 107 which is a secondary sealing seam, so that the bottom is suitable to be folded to form rectangular bottom structure. Similarly, the top left sub-inflation units 111 form inflatable structure 17 of the bottom wall 10*a*. Other three side walls are all un-inflatable structures, so that the top side is suitable to be folded to form rectangular structure. The top portion is not heat sealed via similar end sealing seam 107, so as to form the closable opening 110.

Referring to FIGS. 27 to 42, the stereoscopic air bag formed by the inflatable main body 10 and the inflation valve 20 can be further matched with a functional layer 30. The functional layer 30 is a packaging box, such as a paper packaging box. Before being used, the packaging box is folded to stay in a folded state. The inflatable main body 10 is firmly connected into the packaging box. While the inflatable main body 10 being inflated via the inflation valve 20, the inflated inflatable main body 10 swells to stretch the folded packaging box automatically, so that the air packaging bag formed by the inflatable main body 10 and the packaging box are used together to package item to be packaged.

Figure 43:
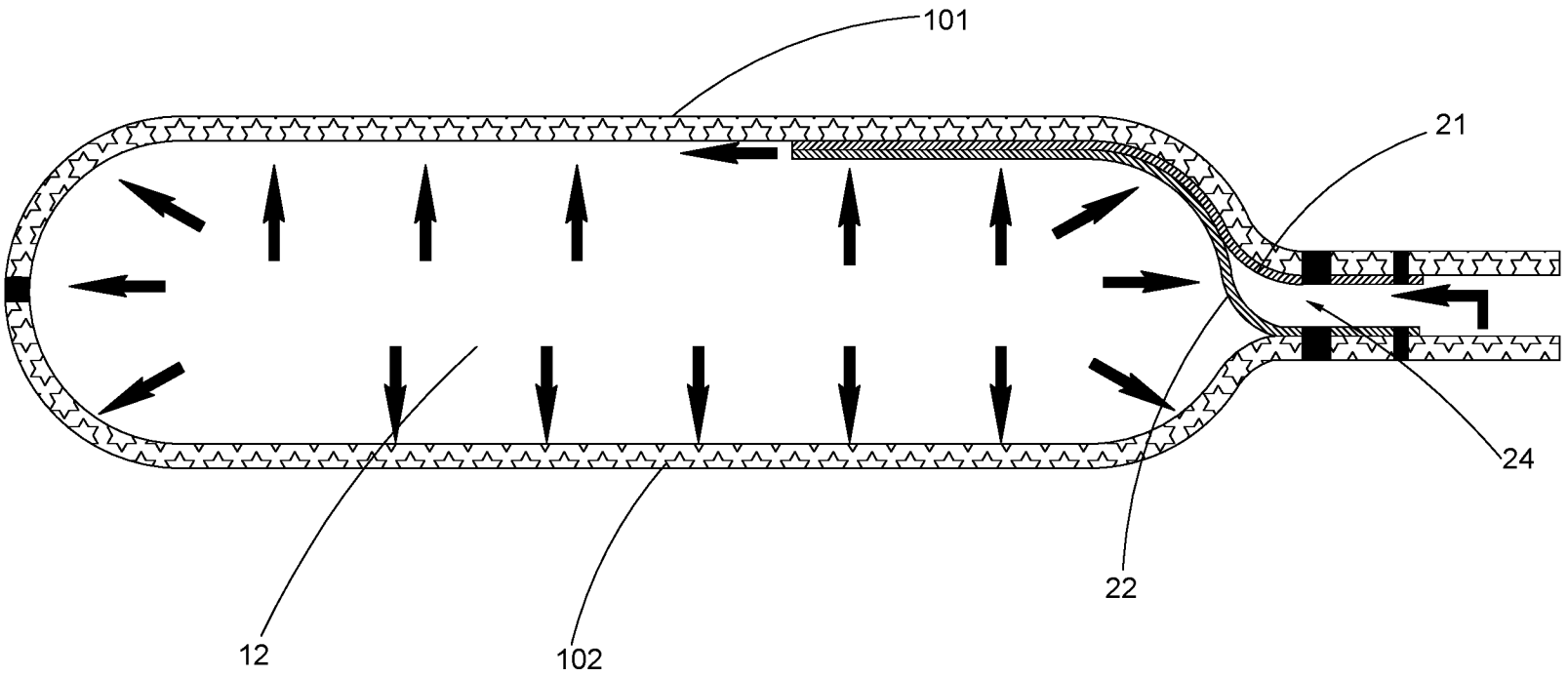
FIG. 43 illustrates an inflation valve of the rectangular air packaging device according to the above embodiments of the present invention.
Figure 44:
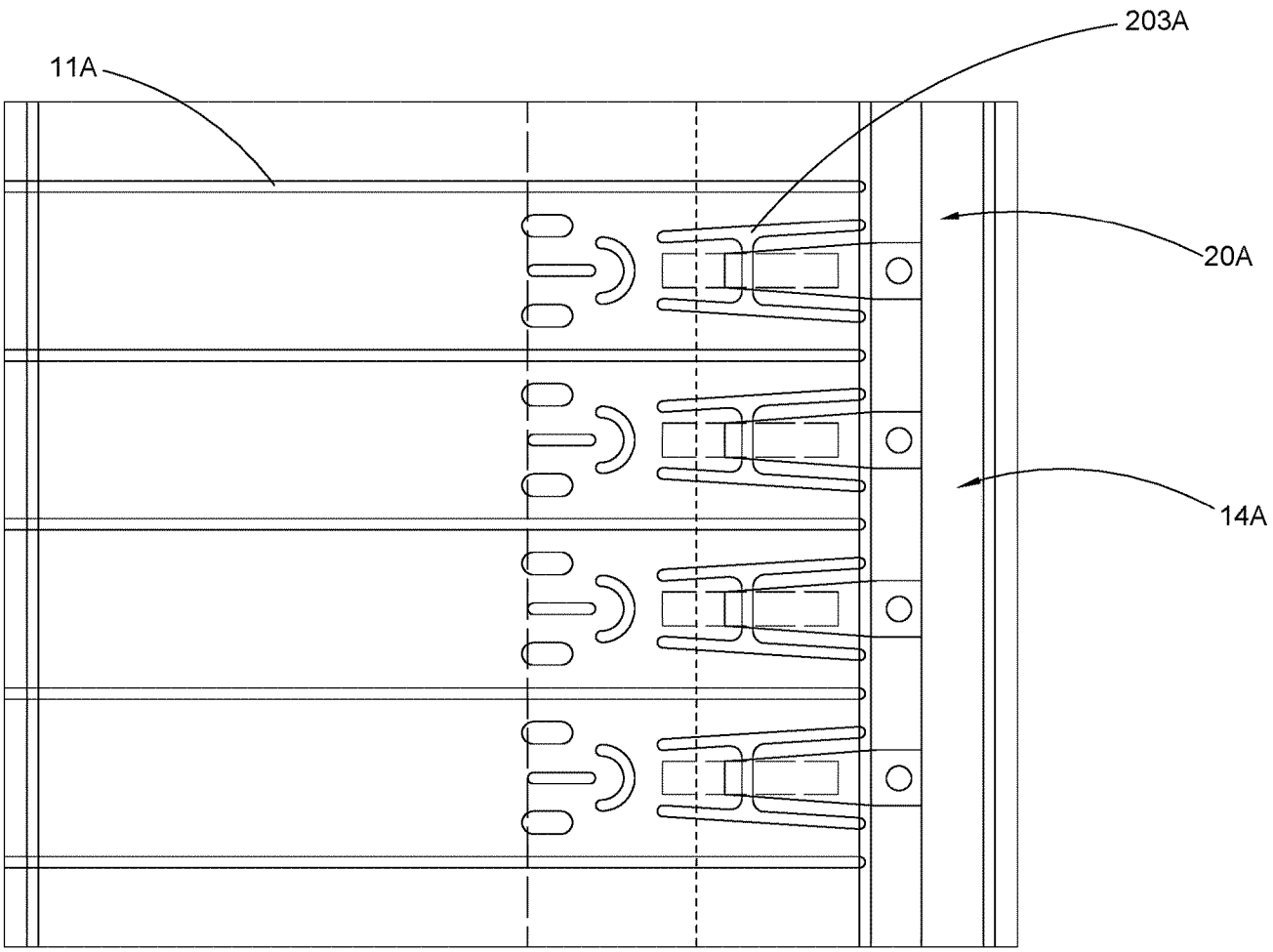
FIG. 44 illustrates another inflation valve of the rectangular air packaging device according to the above embodiments of the present invention.
Figure 45:
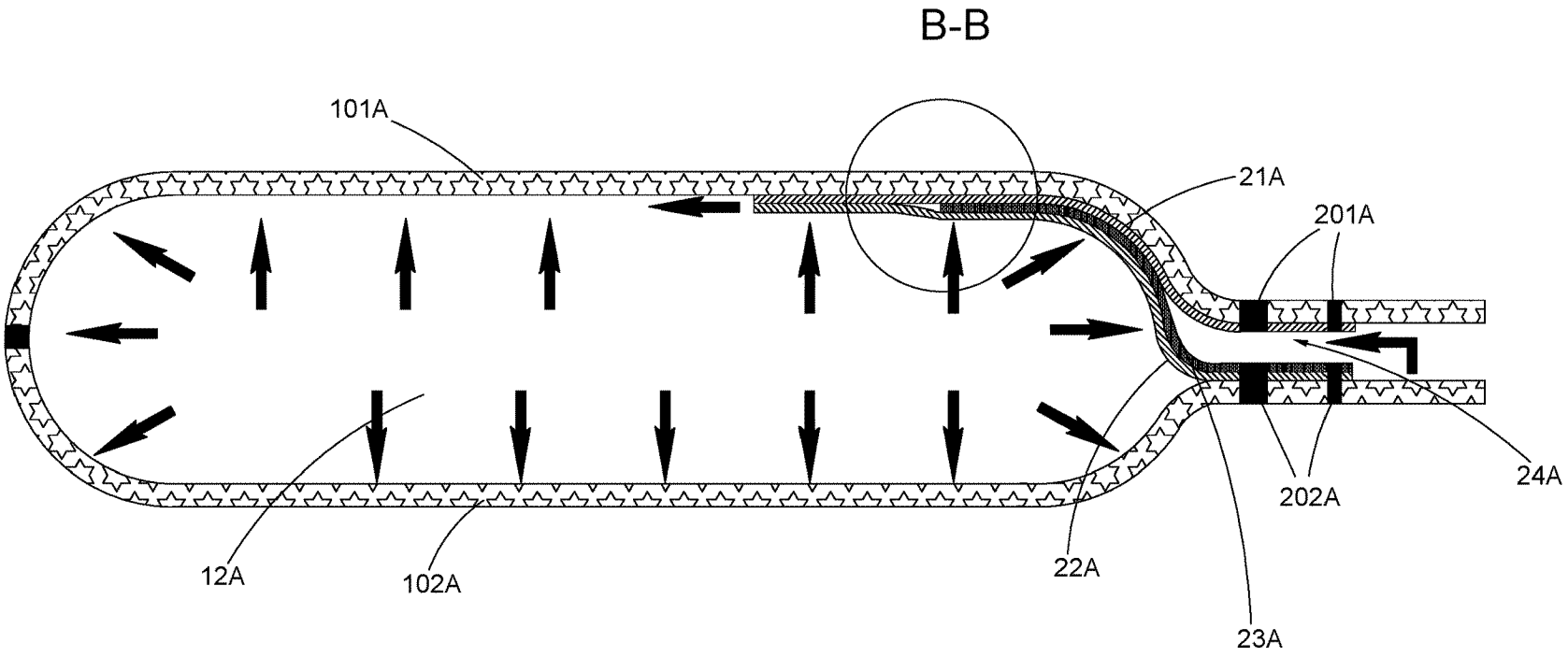
FIG. 45 is a section view of the above inflation valve of the rectangular air packaging device according to the above embodiments of the present invention.
Figure 46A:
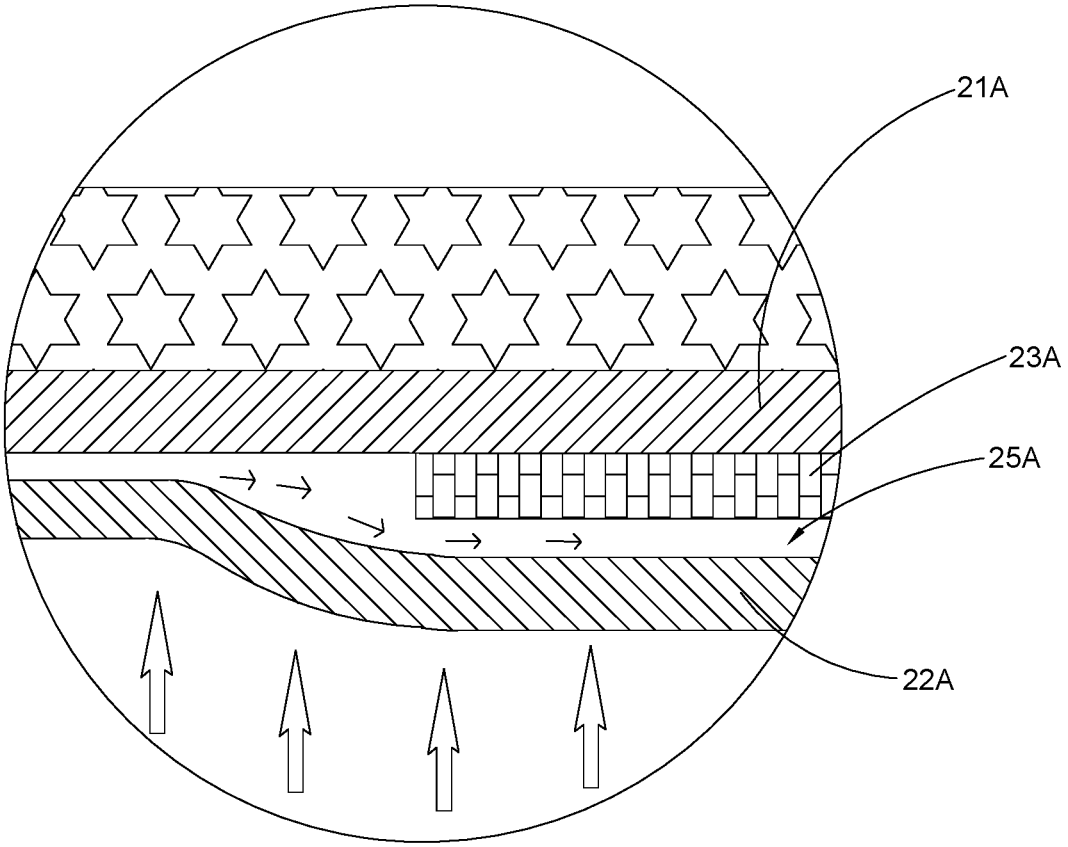
FIG. 46A and FIG. 46B are partial enlarged view of the rectangular air packaging device according to the above embodiments of the present invention.
Figure 46B:
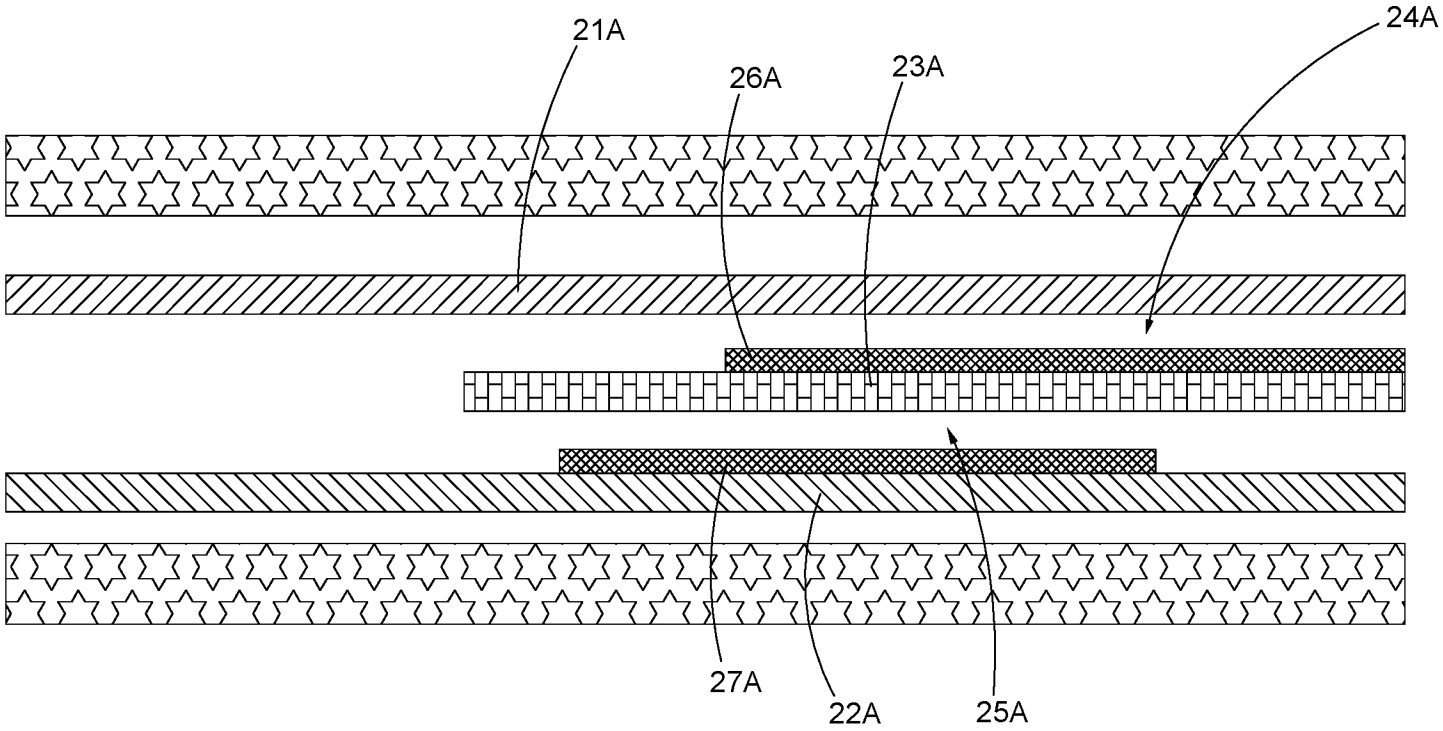

Referring to FIG. 43, the inflation valves 20 are non-return valves, wherein each inflation valve 20 comprises two sealing films 21 and 22 being overlapped between the first chamber layer 101 and the second chamber layer 102, so as to form a four layer structure. A gas inflating channel 24 is formed between the sealing film 21 and 22. Accordingly, after the inflatable main body 10 being inflated, the two sealing films 21 and 22 attach together with each other, so as to seal the gas inflating channel 24, so as to seal gas into each inflation chamber 12 of the inflatable main body 10. If the inflatable main body 10 comprises the inflation units 11, a plurality of inflation valve 20 is correspondingly provided to each inflation unit 11, so as to seal gas into each inflation unit 11. Specially, the first sealing film 21 is overlapped to the first chamber layer 101. The second sealing film 22 is overlapped to the second chamber layer 102. While inflating the inflatable main body 10, gas is guided into the gas inflating channel 24 formed between the first sealing film 21 and the second sealing film 22. After the inflatable main body 10 is full of gas, the first sealing film 21 and the second sealing film 22 attach with each other, so as to seal the gas inflating channel 24 of the air bag. In addition, the pressure in the inflatable main body acts to the two sealing films 21 and 22, so as to ensure the two sealing films 21 and 22 attach together with each other, so as to prevent gas from leaking out of the inflation valves 20. In other words, the inflation valves are non-return valves, which allow gas entering into the inflatable main body 10 only, but can prevent gas from leaking.

The forming of the gas inflating channel 24 of the inflation valve 20 can be realized between the two sealing films 21 and 22, so that while heat-sealing the two sealing films 21 and 22 and the two chamber layers 101 and 102, the two sealing films 21 and 22 will not be heat sealing together due to an obstructing device is provided, so as to form the gas inflating channel 24. According to a specific embodies, the obstructing device is made of heat-resisting printing ink.

FIG. 44 to FIG. 46B illustrate the structure of another inflation valve 20A, the inflation valve 20A is a non-return valve, so as to provide double sealing effect to the air bag. The inflation valve 20A comprises a first sealing film 21A, a second sealing film 22A and a non-return sealing film 23A.

The first sealing film 21A and the second sealing film 22A are overlapped between the first chamber layer 101A and the second chamber layer 102A of the inflation unit 11. The first sealing film 21A and the second sealing film 22A are two thin flexibility films overlapped with each other made of plastic. Preferably, the first sealing film 21A and the second sealing film 22A are same films.

Each one of the first the sealing films 21A and the second sealing films 22A has a proximal edge extended to the entrance of the inflation valve 20A being provided at the inflation unit 11, and a distal edge extended into the inflation units. Preferably, the edge of the proximal edge and the distal edge of the first sealing film 21A and the second sealing film 22A are respectively connected with each other.

According to this preferred embodiment, the proximal edge of the first sealing film 21A is contacted to the first chamber layer 101A. The proximal edge of the second sealing film 22A is contacted to the second chamber layer 102A.

The non-return sealing film 23A is overlapped to the proximal end of the first sealing film 21A and the second sealing film 22A, so as to form an gas inflating channel 24A between the first sealing film 21A and the non-return sealing film 23A, and to form a non-return channel 25A between the non-return sealing film 23A and the second sealing film 22A.

The gas inflating channel 24A are provided to inflate gas into the inflation unit 11 via the inflating cavity 12A, until the pressure in the inflating cavity 12A makes the distal ends of the first sealing film 21A and the second sealing film 22A to be sealed to close the gas inflating channel 24A. According to this preferred embodiment of the present invention, if gas is leaked between the distal end of the first sealing film 21A and the distal end of the second sealing film 22A, the gas in the inflating cavity 12A is guided into the non-return channel 25A, so as to product pressure supplement, so as to further seal the gas inflating channel 24A, so as to enhance the sealing effect between the first sealing film 21A and the second sealing film 22A, as illustrated in the.

The gas inflating channel 24A has two opening ends, wherein the proximal opening end is formed between the proximal end of the first sealing film 21A and the proximal end of the non-return sealing film 23A. The distal opening end is extended to the distal ends of the first sealing film 21A and the second sealing film 22A, so as to communicate with the inflating cavity 12A. Pressed gas can be guided into the inflating cavity via the gas inflating channel 24A.

It is worth mentioning that after the inflation unit 11 is full of gas, the press in the inflating cavity 12A press to the first sealing film 21A and the second sealing film 22A, so as to seal the distal ends of the first sealing film 21A and the second sealing film 22A, and to seal the far openings ends of the gas inflating channel 24A. In addition, the distal end of the first sealing film 21A and the distal end of the second sealing film 22A are sealed together due to surface tension.

The non-return sealing film 23A is thin flexibility film made of plastic. Preferably, the non-return sealing film 23A, the first sealing film 21A and the second sealing film 22A are PE films. In addition, the thickness of each first chamber layer 101A and each second chamber layer 102A is bigger than the thickness of each first sealing film 21A, each second sealing film 22A and each non-return sealing film 23A.

According to this preferred embodiment of the present invention, the length of the non-return sealing film 23A is smaller than the length of each first sealing film 21A and each second sealing film 22A, so that when the non-return sealing film 23A is overlapped with the first sealing film 21A and the second sealing film 22A, the distal end of the first sealing film 21A and the distal end of the second sealing film 22A are overlapped together. It is worth mentioning that the length of the non-return sealing film 23A is the distance between the proximal end of the non-return sealing film 23A and the distal end of the non-return sealing film 23A. The length of the first sealing film 21A is the distance between the proximal end of the first sealing film 21A and the distal end of the first sealing film 21A. The length of the second sealing film 22A is the distance between the proximal end of the second sealing film 22A and the distal end of the second sealing film 22A.

Accordingly, the proximal ends of the first sealing film 21A and the second sealing film 22A are provided near to the proximal end of the non-return sealing film 23A. In addition, the proximal end of the non-return sealing film 23A contacts with the proximal end of the second sealing film 22A.

The non-return channel 25A is formed between the non-return sealing film 23A and the second sealing film 22A. The non-return channel 25A has an opening end facing to the inflating cavity 12A and a closed end facing to the opening of the inflation valves. In other words, the proximal end of the non-return channel 25A is the closed end, and the distal end of the non-return channel 25A is the opening end.

Accordingly, while gas is inflated into the non-return channel 25A via the opening end, the non-return channel 25A is inflated with air to imply the pressure, so as to further seal the gas inflating channel 24A between the first sealing film 21A and the second sealing film 22A.

It is worth mentioning that while inflating gas into the inflating cavity via the gas inflating channel 24A, the flow direction of the gas in the gas inflating channel 24A is opposite with the flow direction of the gas in the non-return. Hence, the gas will not be inflated into the non-return channel 25A. If gas is leaked to the non-return channel 25A via the inflating cavity 12A, the gas enters into the non-return channel 25A, so as to imply the pressure and further seal the gas inflating channel 24A, so as to prevent from gas leaking. It is worth mentioning that, before gas is leaked via the near opening end of the gas inflating channel 24A, the gas flows from the far opening end of the gas inflating channel 24A to the far opening end of the non-return channel 25A, so as to prevent from gas leaking. In addition, the non-return sealing film 23A and the first sealing film 21A are sealed together to seal the gas inflating channel 24A under the function of surface tension.

In order to provide the inflation valve 20A to the inflation unit 11, the inflation valve 20A further comprises a first sealing joint 201 sealing the first chamber layer 101A and the first sealing film 21A together at the valve opening of the inflation unit 11, and a second sealing joint 202 sealing the second chamber layer 102A, the non-return sealing film 23A and the second sealing film 22A together at the valve opening of the inflation unit 11.

Accordingly, the proximal end of the first sealing film 21A is attached with the first chamber layer 101A by the first sealing joint 201. The second chamber layer 102A is attached together with the proximal end of the second sealing film 22A and the proximal end of the non-return sealing film 23A via the second sealing joint 202A. Preferably, two interval sealing joints 201A are used to attach the first chamber layer 101A and the first sealing film 21A. Two interval second sealing joints 202A are used to attach the second chamber layer 102A, the non-return sealing film 23A and the second sealing film 22A. It is worth mentioning that, the first sealing joint 201A and the second sealing joint 202A can be heat-sealing lines or other shapes, such as a shape as a moon. In other words, the proximal end of the first sealing film 21A is heat-sealed together with the first chamber layer 101A at the sealing joint 201A. The second chamber layer 102A, the proximal end of the second sealing film 22A, and the proximal end of the non-return sealing film 22 are heat-sealed together with the second sealing joint 202A.

In order to ensure space can be kept between the first sealing film 21A and the non-return sealing film 23A at the heat-sealing process, the inflation valve 20A further comprises a first heat-resisting element 26A being provided between the first sealing film 21A and the non-return sealing film 23A, so as to ensure the gas inflating channel 24A can be formed. The first heat-resisting element 26A is used to prevent the first sealing film 21A and the non-return sealing film 23A from being attached together at the heat-sealing process.

In detail, the first heat-resisting element 26A is provided at the proximal ends of the first sealing film 21A and the non-return sealing film 23A and to the valve opening of the inflation unit 11, so as to ensure the proximal end of the gas inflating channel 24A being kept in an opening state.

In similar, in order to keep space between the second sealing film 22A and the non-return sealing film 23A at the heat-sealing process, the inflation valve 20A further comprises a second heat-resisting element 27A formed between the second sealing film 22A and the non-return sealing film 23A, so as to ensure the non-return channel 25A being formed.

In detail, the second heat-resisting element 27A is provided to the distal ends of the second sealing film 22A and the non-return sealing film 23A, so as to ensure the distal end of the non-return channel 25A can be kept in an opening state. It is worth mentioning that the proximal end of the non-return channel 25A is closed by the second sealing joint 202.

According to this preferred embodiment, the first heat-resisting element 26A and the second heat-resisting element 27A are two heat-resisting layers being coated to the predetermined position of respect corresponding films, so as to prevent the first heat-resisting element 26A and the second heat-resisting element 27A from being attached together at the sealing process. The first heat-resisting element 26A is extended to the proximal end of the non-return sealing film 23A, and faces to the first sealing film 21A. The second heat-resisting element 27A is extended to the distal end of the non-return sealing film 23A at the opposite side, and faces to the second sealing film 22A, wherein the second heat-resisting element 27A isn't provided to the opposite side of the proximal end of the non-return sealing film 23A, thus the proximal end of the non-return channel 25A can be closed by the second sealing joint 202A. It is worth mentioning that the second heat-resisting element 27A can not only avoid the non-return sealing film 23A from attach together without the second sealing film 22A, so as to ensure the distal end of the non-return channel 25A being kept in the opening state, and enhance the act of the non-return sealing film 23A and the first sealing film 21A, so as to close the gas inflating channel 24A at the act of surface tension.

The inflation valve 20A further comprises two side sealing joint s 203A, i.e. two sealing joints, so as to attach the first sealing film 21A and the non-return sealing film 23A, so as to form the side walls of the gas inflating channel 24A. The width of the gas inflating channel 24A is defined by the two sides sealing joint 203A. In detail, the two side sealing joint 203A are two slant heat-sealing lines, so that the width of the gas inflating channel 24A decrease progressively from the valve opening of each inflating cavity. In other words, the near opening end of the gas inflating channel 24A is a bigger opening end communicating with the valve opening. The far opening end of the gas inflating channel 24A is a taper opening end communicating with the inflating cavity 12A. The taper gas inflating channel 24A further avoids gas from leaking from the inflating cavity 12A to the valve opening.

Preferably, the side sealing joint 203A is extended from the proximal end of the first sealing film 21A and the second sealing film 22A to the distal end of the first sealing film 21A and the second sealing film 22A. Hence, the side sealing joint 203A is provided to the proximal end of the first sealing film 21A and the second sealing film 22A and is attached together with the non-return sealing film 23A. The side sealing joint 203A is provided to the distal end of the first sealing film 21A and the second sealing film 22A, and is attached together with the first sealing film 21A and the second sealing film 22A.

Accordingly, in order to inflate into the inflation unit 11, the inserting head of the pump is inserted to the air inflating opening 13A, so as to inflate pressed gas into the gas inflating channel 24A, wherein the inflating direction is from the proximal end of the gas inflating channel 24A to the distal end of the inflating channel 24A. Thus the inflation unit 11 can be inflated. The pressure in the inflating cavity 12A becomes bigger, so as to stretch the first chamber layer 101A and the second chamber layer 102A. At the same time, the pressure acts to the first sealing film 21A and the second sealing film 22A, particularly acts to the distal ends of the first sealing film 21A and the second sealing film 22A. When the inflation unit 11 is full of gas, the volume of the gas being inflated reaches to the biggest value, the pressure in the inflating cavity 12A is big enough to seal the distal ends of the first sealing film 21A and the second sealing film 22A, so as to seal the far opening end of the gas inflating channel 24A automatically. Then the inserting foot of the pump can be pulled out of the air inflating opening 13A.

If the distal ends of the first sealing film 21A and the second sealing film 22A are not sealed together, gas in the inflating cavity 12A may be leaked to the gas inflating channel 24A. In order to avoid gas from being leaking to the gas inflating channel 24A, the non-return sealing film 23A and the first sealing film 21A are sealed, so as to seal the far opening of the gas inflating channel 24A. In detail, the air inflating direction of the non-return channel 25A is opposite with the inflating direction of the gas inflating channel 24A. In addition, when the opening end of the non-return channel 25A is opened, the far opening end of the gas inflating channel 24A is closed. Hence, gas enters into and is reminded in the non-return channel 25A from the opening end of the non-return channel 25A.

The non-return channel 25A is inflated with gas. The pressure in the non-return channel 25A is supplemented, so as to further seal the gas inflating channel 24A. Specially, the far opening end of the gas inflating channel 24A between the first sealing film 21A and the non-return sealing film 23A is sealed. In more detail, the higher the supplemented pressure in the non-return channel 25A is, the sealing effect of the non-return sealing film 23A is. In other words, before gas is leaked from the inflating cavity 12A to reduce the pressure in the inflating cavity 12A, the gas enters into the non-return channel 25A, so as to increase the pressure in the non-return channel 25A. Hence, the total pressure of the press provided by the gas being inflated, i. e. the total pressure of the inflating cavity 12A and the non-return channel 25A reminds unchanged. Hence, the gas entered into the non-return channel 25A from the inflating cavity 12A can enhance the sealing effect of the gas inflating channel 24A.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A rectangular air packaging device for packaging an item, comprising an inflatable main body, a plurality of bending seams, a plurality of dividing seams, and at least one inflation valve, wherein said inflatable main body comprises a plurality of inflation units each having an inflation chamber communicating with said inflation valve, wherein said dividing seams divide said inflatable main body into said inflation units, wherein said inflation unit is bended and heat-sealed to form a plurality of side walls, wherein after said plurality of inflation units are bended, each said inflation unit forms a plurality of sub-inflation units, wherein said bending seams are sealed and formed at said inflation units respectively to divide said inflation units into said sub-inflation units, wherein said bending seams are lined up to enable said inflation units being bent along said bending seams, wherein said inflatable main body further comprises a plurality of sub-dividing seams which divides said corresponding sub-inflation units into a plurality of secondary inflation units, so as to form two un-inflatable adjusting portions easy to be bended at corners of said rectangular air packaging device, wherein each of said sub-dividing seams is positioned between two of said dividing seams, wherein two ends of each of said sub-dividing seams are extended to two of said bending seams respectively, such that said secondary inflation units are communicated to said sub-inflation units, wherein each of said un-inflatable adjusting portions enables two neighboring side walls formed by said sub-inflation units, which are integrally connected with said un-inflatable adjusting portion, to be arranged to define a right angle, so as to form a rectangular containing cavity by said plurality of side walls to contain the item to be packaged.

2. The rectangular air packaging device, as recited in claim 1, wherein each of said un-inflatable adjusting portions is inserted into said rectangular containing cavity.

3. The rectangular air packaging device, as recited in claim 1, wherein each of said un-inflatable adjusting portions is extended out of said rectangular containing cavity.

4. The rectangular air packaging device, as recited in claim 1, further comprising a plurality of sub-bending seams provided on said plurality of secondary inflation units respectively and formed at said sub-dividing seams respectively, wherein said plurality of secondary inflation units automatically bend along said plurality of sub-bending seams respectively after said plurality of secondary inflation units are respectively inflated.

5. The rectangular air packaging device, as recited in claim 2, further comprising a plurality of sub-bending seams provided on said plurality of secondary inflation units respectively and formed at said sub-dividing seams respectively, wherein said plurality of secondary inflation units automatically bend along said plurality of sub-bending seams respectively after said plurality of secondary inflation units are respectively inflated.

6. The rectangular air packaging device, as recited in claim 3, further comprising a plurality of sub-bending seams provided on said plurality of secondary inflation units respectively and formed at said sub-dividing seams respectively, wherein said plurality of secondary inflation units automatically bend along said plurality of sub-bending seams respectively after said plurality of secondary inflation units are respectively inflated.

7. The rectangular air packaging device, as recited in claim 4, wherein each of said un-inflatable adjusting portions is provided with two said sub-bending seams which are respectively inclinedly extended with respect to said dividing seams.

8. The rectangular air packaging device, as recited in claim 5, wherein each of said un-inflatable adjusting portions is provided with two said sub-bending seams which are respectively inclinedly extended with respect to said dividing seams.

9. The rectangular air packaging device, as recited in claim 6, wherein each of said un-inflatable adjusting portions is provided with two said sub-bending seams which are respectively inclinedly extended with respect to said dividing seams.

10. The rectangular air packaging device, as recited in claim 1, wherein said inflatable main body comprises a first chamber layer and a second chamber layer which are overlapped with each other to form each said inflation unit via a sealing technology, wherein said inflation valve comprises two valve films heat-sealed together with said first chamber layer and said second chamber layer respectively defining a plurality of gas inflating channels between said two valve films, wherein after inflating said plurality of inflation units via said plurality of inflating channels respectively, inner surfaces of said two valve films adhere to each other automatically, so as to prevent the gas entered into said inflation units from leaking through said air inflating channels.

11. The rectangular air packaging device, as recited in claim 4, wherein said inflatable main body comprises a first chamber layer and a second chamber layer which are overlapped with each other to form each said inflation unit via a sealing technology, wherein said inflation valve comprises two valve films heat-sealed together with said first chamber layer and said second chamber layer respectively defining a plurality of gas inflating channels between said two valve films, wherein after inflating said plurality of inflation units via said plurality of inflating channels respectively, inner surfaces of said two valve films adhere to each other automatically, so as to prevent the gas entered into said inflation units from leaking through said air inflating channels.

12. The rectangular air packaging device, as recited in claim 9, wherein said inflatable main body comprises a first chamber layer and a second chamber layer which are overlapped with each other to form each said inflation unit via a sealing technology, wherein said inflation valve comprises two valve films heat-sealed together with said first chamber layer and said second chamber layer respectively defining a plurality of gas inflating channels between said two valve films, wherein after inflating said plurality of inflation units via said plurality of inflating channels respectively, inner surfaces of said two valve films adhere to each other automatically, so as to prevent the gas entered into said inflation units from leaking through said air inflating channels.

13. The rectangular air packaging device, as recited in claim 1, further comprising a packaging box, wherein said inflatable main body is connected in said packaging box, wherein while inflating said inflatable main body, said packaging box in a folded state is automatically stretched.

14. The rectangular air packaging device, as recited in claim 4, further comprising a packaging box, wherein said inflatable main body is connected in said packaging box, wherein while inflating said inflatable main body, said packaging box in a folded state is automatically stretched.

15. The rectangular air packaging device, as recited in claim 9, further comprising a packaging box, wherein said inflatable main body is connected in said packaging box, wherein while inflating said inflatable main body, said packaging box in a folded state is automatically stretched.

16. The rectangular air packaging device, as recited in claim 12, further comprising a packaging box, wherein said inflatable main body is provided in said packaging box, wherein while inflating said inflatable main body, said packaging box in a folded state is automatically stretched.

* * * * *